US009756448B2

(12) United States Patent
Purnhagen et al.

(10) Patent No.: US 9,756,448 B2
(45) Date of Patent: Sep. 5, 2017

(54) EFFICIENT CODING OF AUDIO SCENES COMPRISING AUDIO OBJECTS

(71) Applicant: DOLBY INTERNATIONAL AB, Amsterdam Zuidoost (NL)

(72) Inventors: Heiko Purnhagen, Sundbyberg (SE); Janusz Klejsa, Bromma (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/300,159

(22) PCT Filed: Mar. 31, 2015

(86) PCT No.: PCT/EP2015/057026
§ 371 (c)(1),
(2) Date: Sep. 28, 2016

(87) PCT Pub. No.: WO2015/150384
PCT Pub. Date: Oct. 8, 2015

(65) Prior Publication Data

US 2017/0180905 A1 Jun. 22, 2017

Related U.S. Application Data

(60) Provisional application No. 61/973,625, filed on Apr. 1, 2014, provisional application No. 62/068,446, filed on Oct. 24, 2014.

(51) Int. Cl.
*H04S 3/00* (2006.01)
*H04R 5/00* (2006.01)
(Continued)

(52) U.S. Cl.
CPC ..... *H04S 7/302* (2013.01); *G10L 19/008* (2013.01); *H04S 3/008* (2013.01); *H04S 2400/01* (2013.01);
(Continued)

(58) Field of Classification Search
CPC .. H04S 7/301; H04S 2400/13; H04S 2400/01; G06F 3/165; H04R 2410/05; H04R 2430/01; H04R 29/00
See application file for complete search history.

(56) References Cited

U.S. PATENT DOCUMENTS 7,394,903 B2 7/2008 Herre
7,567,675 B2 7/2009 Bharitkar
(Continued)

FOREIGN PATENT DOCUMENTS

EP 2273492 1/2011
GB 2485979 6/2012
(Continued)

OTHER PUBLICATIONS

Herre, J. et al "MPEG Spatial Audio Object Coding—The ISO/MPEG Standard for Efficient Coding of Interactive Audio Scenes" JAES vol. 60 Issue 9, pp. 655-673, Sep. 2012.
(Continued)

*Primary Examiner* — Muhammad N Edun

(57) ABSTRACT

There is provided encoding and decoding methods for encoding and decoding of object based audio. An exemplary decoding method described is for reconstructing audio objects based on a data stream, wherein the data stream corresponds to a plurality of time frames, wherein the data stream comprises a plurality of side information instances, wherein the data stream further comprises, for each side information instance, transition data including two independently assignable portions which in combination define a point in time to begin a transition from a current reconstruction setting to a desired reconstruction setting specified by the side information instance, and a point in time to complete the transition.

20 Claims, 10 Drawing Sheets

(51) Int. Cl.
*H04S 7/00* (2006.01)
*G10L 19/008* (2013.01)

(52) U.S. Cl.
CPC ..... *H04S 2400/03* (2013.01); *H04S 2400/11* (2013.01)

(56) References Cited

U.S. PATENT DOCUMENTS

| | | | | |
|---|---|---|---|---|
| 7,680,288 | B2 | 3/2010 | Melchior | |
| 8,135,066 | B2 | 3/2012 | Harrison | |
| 8,379,868 | B2 | 2/2013 | Goodwin | |
| 8,396,575 | B2 | 3/2013 | Kraemer | |
| 8,620,465 | B2 | 12/2013 | Van Den Berghe | |
| 2004/0044520 | A1* | 3/2004 | Chen | G10L 19/0017 704/200.1 |
| 2005/0105442 | A1 | 5/2005 | Melchior | |
| 2005/0114121 | A1 | 5/2005 | Tsingos | |
| 2009/0125313 | A1 | 5/2009 | Hellmuth | |
| 2009/0240505 | A1 | 9/2009 | Villemoes | |
| 2010/0198589 | A1 | 8/2010 | Ishikawa | |
| 2010/0284549 | A1 | 11/2010 | Oh | |
| 2011/0015770 | A1 | 1/2011 | Seo | |
| 2011/0040398 | A1 | 2/2011 | Hotho et al. | |
| 2011/0081023 | A1 | 4/2011 | Raghuvanshi | |
| 2011/0182432 | A1 | 7/2011 | Ishikawa | |
| 2012/0182385 | A1 | 7/2012 | Kanamori | |
| 2012/0232910 | A1 | 9/2012 | Dressler | |
| 2012/0243690 | A1 | 9/2012 | Engdegard | |
| 2012/0259643 | A1 | 10/2012 | Engdegard | |
| 2012/0321105 | A1 | 12/2012 | McGrath | |
| 2013/0028426 | A1 | 1/2013 | Purnhagen | |
| 2013/0142340 | A1* | 6/2013 | Sehlstrom | G10L 21/0364 381/17 |
| 2014/0023196 | A1 | 1/2014 | Xiang | |

FOREIGN PATENT DOCUMENTS

| | | |
|---|---|---|
| JP | 2012-516461 | 7/2012 |
| KR | 10-2009-0013178 | 2/2009 |
| KR | 10-2009-0018839 | 2/2009 |
| RU | 2407073 | 12/2010 |
| RU | 2449385 | 4/2012 |
| RU | 2452043 | 5/2012 |
| RU | 2455708 | 7/2012 |
| WO | 2008/046530 | 4/2008 |
| WO | 2010/125104 | 11/2010 |
| WO | 2013/142657 | 9/2013 |
| WO | 2014/015299 | 1/2014 |
| WO | 2014/025752 | 2/2014 |
| WO | 2014/099285 | 6/2014 |
| WO | 2014/161993 | 10/2014 |
| WO | 2014/187986 | 11/2014 |
| WO | 2014/187988 | 11/2014 |
| WO | 2014/187989 | 11/2014 |

OTHER PUBLICATIONS

Herre, J. et al "MPEG Surround—The ISO/MPEG Standard for Efficient and Compatible Multichannel Audio Coding" JAES vol. 56, Issue 11, pp. 932-955, Nov. 2008.

Boustead, P. et al "DICE: Internet Delivery of Immersive Voice Communication for Crowded Virtual Spaces" IEEE Virtual Reality, Mar. 12-16, 2005, pp. 35-41.

Capobianco, J. et al "Dynamic Strategy for Window Splitting, Parameters Estimation and Interpolation in Spatial Parametric Audio Coders" IEEE International Conference on Acoustics, Speech and Signal Processing, Mar. 25-30, 2012, pp. 397-400.

"Dolby Atmos Next-Generation Audio for Cinema", Apr. 1, 2012 (available at http://www.dolby.com/us/en/professional/cinema/products/dolby-atmos-next-generation-audio-for-cinema-white-paper.pdf.

Engdegard J. et al "Spatial Audio Object Coding (SAOC)—The upcoming MPEG Standard on Parametric Object Based Audio Coding" Journal of the Audio Engineering Society, New York, US, May 17, 2008, pp. 1-16.

Herre, J. et al "The Reference Model Architecture for MPEG Spatial Audio Coding" AES convention presented at the 118th Convention, Barcelona, Spain, May 28-31, 2005.

Innami, S. et al "On-Demand Soundscape Generation Using Spatial Audio Mixing" IEEE International Conference on Consumer Electronics, Jan. 9-12, 2011, pp. 29-30.

Innami, S. et al "Super-Realistic Environmental Sound Synthesizer for Location-Based Sound Search System" IEEE Transactions on Consumer Electronics, vol. 57, Issue 4, pp. 1891-1898, Nov. 2011.

Schuijers, E. et al "Low Complexity Parametric Stereo Coding in MPEG-4" AES Convention, paper No. 6073, May 2004.

Herre, J. et al "MPEG Surround—The ISO/MPEG Standard for Efficient and Compatible Multichannel Audio Coding" JAES vol. 56, Issue 11, pp. 932-955, Dec. 8, 2008.

Tsingos, N. et al "Perceptual Audio Rendering of Complex Virtual Environments" ACM Transactions on Graphics, vol. 23, No. 3, Aug. 1, 2004, pp. 249-258.

Herre, J. et al "MPEG Spatial Audio Object Coding—The ISO/MPEG Standard for Efficient Coding of Interactive Audio Scenes" JAES vol. 60, Issue 9, pp. 655-673, Sep. 2012.

* cited by examiner

EFFICIENT CODING OF AUDIO SCENES COMPRISING AUDIO OBJECTS

CROSS-REFERENCE TO RELATED APPLICATIONS

This application claims priority to U.S. Provisional Patent Application No. 61/973,625 filed 1 Apr. 2014 and U.S. Provisional Patent Application No. 62/068,446 filed 24 Oct. 2014, each of which is hereby incorporated by reference in its entirety.

TECHNICAL FIELD

The disclosure herein generally relates to coding of an audio scene comprising audio objects. In particular, it relates to an encoder, a decoder and associated methods for encoding and decoding of audio objects.

BACKGROUND

An audio scene may generally comprise audio objects and audio channels. An audio object is an audio signal which has an associated spatial position which may vary with time. An audio channel is an audio signal which corresponds directly to a channel of a multichannel speaker configuration, such as a so-called 5.1 speaker configuration with three front speakers, two surround speakers, and a low frequency effects speaker.

Since the number of audio objects typically may be very large, for instance in the order of hundreds of audio objects, there is a need for coding methods which allow the audio objects to be efficiently reconstructed at the decoder side. There have been suggestions to combine the audio objects into a multichannel downmix (i.e. into a plurality of audio channels which corresponds to the channels of a certain multichannel speaker configuration such as a 5.1 configuration) on an encoder side, and to reconstruct the audio objects parametrically from the multichannel downmix on a decoder side.

An advantage of such an approach is that a legacy decoder which does not support audio object reconstruction may use the multichannel downmix directly for playback on the multichannel speaker configuration. By way of example, a 5.1 downmix may directly be played on the loudspeakers of a 5.1 configuration.

A disadvantage with this approach is however that the multichannel downmix may not give a sufficiently good reconstruction of the audio objects at the decoder side. For example, consider two audio objects that have the same horizontal position as the left front speaker of a 5.1. configuration but a different vertical position. These audio objects would typically be combined into the same channel of a 5.1 downmix. This would constitute a challenging situation for the audio object reconstruction at the decoder side which would have to reconstruct approximations of the two audio objects from the same downmix channel, a process that cannot ensure perfect reconstruction and that sometimes even lead to audible artifacts.

There is thus a need for encoding/decoding methods which provide an efficient and improved reconstruction of audio objects.

Side information or metadata is often employed during reconstruction of audio objects from e.g. a downmix. The form and content of such side information may for example affect the fidelity of the reconstructed audio objects and/or the computational complexity of performing the reconstruction. It would therefore be desirable to provide encoding/decoding methods with a new and alternative side information format which allows for increasing the fidelity of reconstructed audio objects, and/or which allows for reducing the computational complexity of the reconstruction.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1:
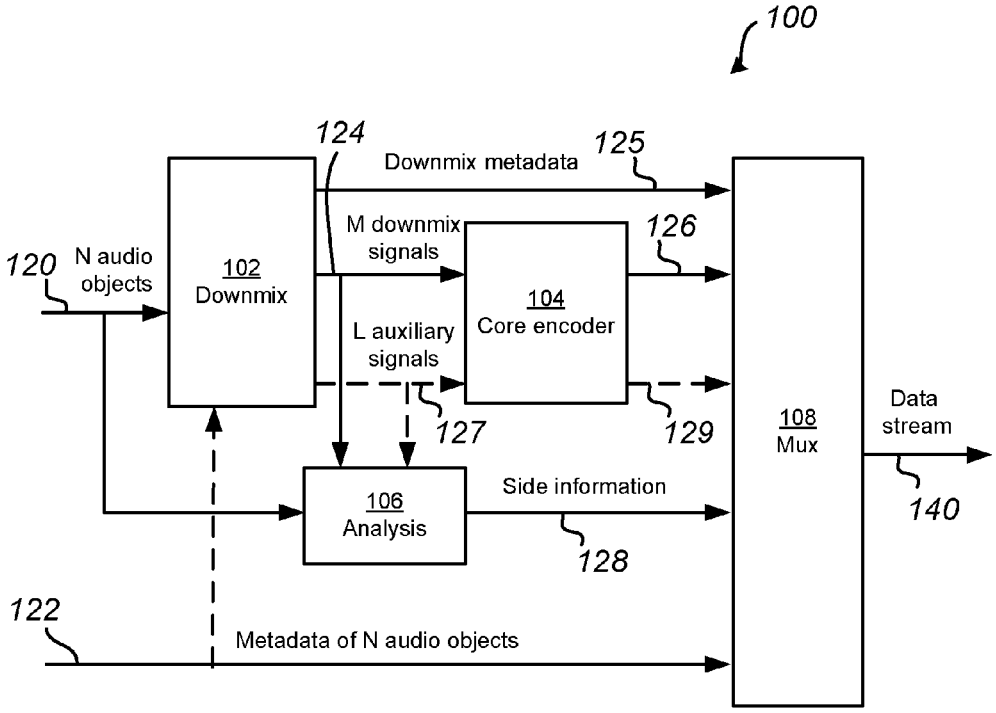
FIG. 1 is a schematic illustration of an encoder according to exemplary embodiments.

In view of the above it is thus an object to provide an encoder, a decoder and associated methods which allow for efficient and improved reconstruction of audio objects, and/or which allows for increasing the fidelity of reconstructed audio objects, and/or which allows for reducing the computational complexity of the reconstruction.

I. Overview—Encoder

According to a first aspect, there is provided an encoding method, an encoder, and a computer program product for encoding audio objects.

According to example embodiments, there is provided a method for encoding audio objects as a data stream. The method comprises:

receiving N audio objects, wherein N>1;

calculating M downmix signals, wherein M≤N, by forming combinations of the N audio objects;

calculating time-variable side information including parameters which allow reconstruction of a set of audio objects formed on the basis of the N audio objects from the M downmix signals; and including the M downmix signals and the side information in a data stream for transmittal to a decoder.

In the present example embodiments, the method further comprises including, in the data stream, wherein the data stream corresponds to a plurality of time frames:

a plurality of side information instances specifying respective desired reconstruction settings for reconstructing the set of audio objects formed on the basis of the N audio objects; and for each side information instance, transition data including two independently assignable portions which in combination define a point in time to begin a transition from a current reconstruction setting to the desired reconstruction setting specified by the side information instance, and a point in time to complete the transition.

The method further comprises, for each specific side information instance of the plurality of side information instances, the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame.

In the present example embodiment, the side information is time-variable, e.g. time-varying, allowing for the parameters governing the reconstruction of the audio objects to vary with respect to time, which is reflected by the presence of the side information instances. By employing a side information format which includes transition data defining points in time to begin and points in time to complete transitions from current reconstruction settings to respective desired reconstruction settings, the side information instances are made more independent of each other in the sense that interpolation may be performed based on a current reconstruction setting and a single desired reconstruction setting specified by a single side information instance, i.e. without knowledge of any other side information instances. The provided side information format therefore facilitates calculation/introduction of additional side information instances between existing side information instances. In particular, the provided side information format allows for calculation/introduction of additional side information instances without affecting the playback quality. In this disclosure, the process of calculating/introducing new side information instances between existing side information instances is referred to as "resampling" of the side information. Resampling of side information is often required during certain audio processing tasks. For example, when audio content is edited, by e.g. cutting/merging/mixing, such edits may occur in between side information instances. In this case, resampling of the side information may be required. Another such case is when audio signals and associated side information are encoded with a frame-based audio codec. In this case, it is desirable to have at least one side information instance for each audio codec frame, preferably with a time stamp at the start of that codec frame, to improve resilience of frame losses during transmission. For example, the audio signals/objects may be part of an audio-visual signal or multimedia signal which includes video content. In such applications, it may be desirable to modify the frame rate of the audio content to match a frame rate of the video content, whereby a corresponding resampling of side information may be desirable.

The data stream in which the downmix signal and the side information is included may for example be a bitstream, in particular a stored or transmitted bitstream.

It is to be understood that calculating the M downmix signals by forming combinations of the N audio objects means that each of the M downmix signals is obtained by forming a combination, e.g. a linear combination, of the audio content of one or more of the N audio objects. In other words, each of the N audio objects need not necessarily contribute to each of the M downmix signals.

The word downmix signal reflects that a downmix signal is a mix, i.e. a combination, of other signals. The downmix signal may for example be an additive mix of other signals. The word "down" indicates that the number M of downmix signals typically is lower than the number N of audio objects.

The downmix signals may for example be calculated by forming combinations of the N audio signals according to a criterion which is independent of any loudspeaker configuration, according to any of the example embodiments within the first aspect. Alternatively, the downmix signals may for example be calculated by forming combinations of the N audio signals such that the downmix signals are suitable for playback on the channels of a speaker configuration with M channels, referred to herein as a backwards compatible downmix.

By the transition data including two independently assignable portions is meant that the two portions are mutually independently assignable, i.e. may be assigned independently of each other. However, it is to be understood that the portions of the transition data may for example coincide with portions of transition data for other types of side information of metadata.

In the present example embodiment, the two independently assignable portions of the transition data, in combination, define the point in time to begin the transition and the point in time to complete the transition, i.e. these two points in time are derivable from the two independently assignable portions of the transition data.

The disclosed method may facilitate a more flexible syntax for encoding audio objects as a data stream.

The disclosed method further may facilitate lossless reframing or resampling of the side information. It should be noted that, throughout this specification, the terms reframing and resampling should be interpreted to mean the same thing and are used interchangeably. Further advantages of the disclosed method will be apparent below in conjunction with the second aspect.

It should be noted that the first aspect may generally have the same features and advantages as the second aspect.

According to an example embodiment, for at least one of the plurality of side information instances, the second time frame is subsequent to the first time frame.

According to an example embodiment, the point in time defined by the transition data for beginning a transition is defined relative a point in time where the corresponding frame begins.

According to an example embodiment, for each specific time frame of the plurality of time frames there are zero or more corresponding side information instances in which the point in time defined by the transition data for beginning a transition corresponds to the specific time frame. According to an example embodiment, for a specific time frame of the plurality of time frames there are zero corresponding side information instances, the method further comprises, if there is a transition defined by a side information instance corresponding to a previous time frame that is not completed for a point in time where the specific time frame begins, generating an additional side information instance by copying the side information instance corresponding to the previous frame and modifying the point in time to begin a transition to a point in time where the time frame begins, and including the additional side information instance in the bitstream.

The term "a specific time frame of the plurality of time frames there are zero corresponding side information instances" should be understood to mean that no side information instance exists corresponding to the specific time frame before the additional side information instance is generated and included in the bitstream.

The present embodiment thus allow for a lossless reframing of the side information instances, as further explained below.

According to an example embodiment, for a specific time frame of the plurality of time frames there are zero corresponding side information instances, the method further comprises, if there is no transition defined by a side information instance corresponding to a previous time frame that is not completed for a point in time where the specific time frame begins, generating an additional side information instance by copying the side information instance corresponding to the previous frame and modifying the point in time to begin a transition to a point in time where the time frame begins, and modifying the point in time for completing a transition to the point in time where the time frame begin, and including the additional side information instance in the bitstream.

By modifying the point in time for completing a transition to the point in time where the time frame begin, the duration of the transition is set to zero, which means that no transition will be done. But by including such additional side information instance in the bitstream, a correct reconstruction setting will be included in the bitstream for the discussed time frame.

The present embodiment thus allows for a lossless reframing of the side information instances, as further explained below.

According to an example embodiment, the method may further comprise a clustering procedure for reducing a first plurality of audio objects to a second plurality of audio objects, wherein the N audio objects constitute either the first plurality of audio objects or the second plurality of audio objects, and wherein the set of audio objects formed on the basis of the N audio objects coincides with the second plurality of audio objects. In the present example embodiment, the clustering procedure may comprise:

calculating time-variable cluster metadata including spatial positions for the second plurality of audio objects; and further including, in the data stream, for transmittal to the decoder:

a plurality of cluster metadata instances specifying respective desired rendering settings for rendering the second set of audio objects; and for each cluster metadata instance, transition data including two independently assignable portions which in combination define a point in time to begin a transition from a current rendering setting to the desired rendering setting specified by the cluster metadata instance, and a point in time to complete the transition to the desired rendering setting specified by the cluster metadata instance.

Since an audio scene may comprise a vast number of audio objects, the method according to the present example embodiment, takes further measures for reducing the dimensionality of the audio scene by reducing the first plurality of audio objects to a second plurality of audio objects. In the present example embodiment, the set of audio objects, which is formed on the basis of the N audio objects and which is to be reconstructed on a decoder side based on the downmix signals and the side information, coincides with the second plurality of audio objects, which corresponds to a simplification and/or lower-dimensional representation of the audio scene represented by the first plurality of audio signals, and the computational complexity for reconstruction on a decoder side is reduced.

The inclusion of the cluster metadata in the data stream allows for rendering of the second set of audio signals on a decoder side, e.g. after the second set of audio signals has been reconstructed based on the downmix signals and the side information.

Similar to the side information, the cluster metadata in the present example embodiment is time-variable, e.g. time-varying, allowing for the parameters governing the rendering of the second plurality of audio objects to vary with respect to time. The format for the downmix metadata may be analogous to that of the side information and may have the same or corresponding advantages. In particular, the form of the cluster metadata provided in the present example embodiment, facilitates resampling of the cluster metadata. Resampling of the cluster metadata may e.g. be employed to provide common points in time to start and complete respective transitions associated with the cluster metadata and the side information, and/or for adjusting the cluster metadata to a frame rate of the associated audio signals.

According to an example embodiment, the clustering procedure may further comprise:

receiving the first plurality of audio objects and their associated spatial positions;

associating the first plurality of audio objects with at least one cluster based on spatial proximity of the first plurality of audio objects;

generating the second plurality of audio objects by representing each of the at least one cluster by an audio object being a combination of the audio objects associated with the cluster; and calculating the spatial position of each audio object of the second plurality of audio objects based on the spatial positions of the audio objects associated with the respective cluster, i.e. with the cluster which the audio object represents.

In other words, the clustering procedure exploits spatial redundancy present in the audio scene, such as objects having equal or very similar locations. In addition, importance values of the audio objects may be taken into account when generating the second plurality of audio objects, as described with respect to example embodiments within the first aspect.

Associating the first plurality of audio objects with at least one cluster includes associating each of the first plurality of audio objects with one or more of the at least one cluster. In some cases, an audio object may form part of at most one cluster, while in other cases an audio object may form part of several clusters. In other words, in some cases, an audio object may be split between several clusters as part of the clustering procedure.

Spatial proximity of the first plurality of audio objects may be related to distances between, and/or relative positions of, the respective audio objects in the first plurality of audio objects. For example, audio objects which are close to each other may be associated with the same cluster.

By an audio object being a combination of the audio objects associated with the cluster is meant that the audio content/signal associated with the audio object may be formed as a combination of the audio contents/signals associated with the respective audio objects associated with the cluster.

According to an example embodiment, the respective points in time defined by the transition data for the respective cluster metadata instances may coincide with the respective points in time defined by the transition data for corresponding side information instances.

By employing the same points in time to begin and to complete transitions associated with the side information and the cluster metadata, joint processing of the side information and the cluster metadata, such as joint resampling, is facilitated.

Moreover, the use of common points in time to begin and to complete transitions associated with the side information and the cluster metadata facilitates joint reconstruction and rendering at a decoder side. If for example, reconstruction and rendering is performed as a joint operation on a decoder side, joint settings for reconstruction and rendering may be determined for each side information instance and metadata instance and/or interpolation between joint settings for reconstruction and rendering may be employed instead of performing interpolation separately for the respective settings. Such joint interpolation may reduce computational complexity at the decoder side as fewer coefficients/parameters need to be interpolated.

According to an example embodiment, the clustering procedure may be performed prior to the calculation of the M downmix signals. In the present example embodiment, the first plurality of audio objects corresponds to the original audio objects of the audio scene, and the N audio objects on the basis of which the M downmix signals are calculated constitute the second, reduced, plurality of audio objects. Hence, in the present example embodiment, the set of audio objects (to be reconstructed on a decoder side) formed on the basis of the N audio objects coincides with the N audio objects.

Alternatively, the clustering procedure may be performed in parallel with the calculation of the M downmix signals. According to the present alternative, the N audio objects on the basis of which the M downmix signals are calculated constitute the first plurality of audio objects which correspond to the original audio objects of the audio scene. With this approach, the M downmix signals are hence calculated on basis of the original audio objects of the audio scene and not on basis of a reduced number of audio objects.

According to an example embodiment, the method may further comprise:

associating each downmix signal with a time-variable spatial position for rendering the downmix signals, and further including, in the data stream, downmix metadata including the spatial positions of the downmix signals, wherein the method further comprises including, in the data stream:

a plurality of downmix metadata instances specifying respective desired downmix rendering settings for rendering the downmix signals; and for each downmix metadata instance, transition data including two independently assignable portions which in combination define a point in time to begin a transition from a current downmix rendering setting to the desired downmix rendering setting specified by the downmix metadata instance, and a point in time to complete the transition to the desired downmix rendering setting specified by the downmix metadata instance.

Including downmix metadata in the data stream is advantageous in that it allows for low-complexity decoding to be used in case of legacy playback equipment. More precisely, the downmix metadata may be used on a decoder side for rendering the downmix signals to the channels of a legacy playback system, i.e. without reconstructing the plurality of audio objects formed on the basis of the N objects, which typically is a computationally more complex operation.

According to the present example embodiment, the spatial positions associated with the M downmix signals may be time-variable, e.g. time-varying, and the downmix signals may be interpreted as dynamic audio objects having an associated position which may change between time frames or downmix metadata instances. This is in contrast to prior art systems where the downmix signals correspond to fixed spatial loudspeaker positions. It is recalled that the same data stream may be played in an object oriented fashion in a decoding system with more evolved capabilities.

In some example embodiments, the N audio objects may be associated with metadata including spatial positions of the N audio objects, and the spatial positions associated with the downmix signals may for example be calculated based on the spatial positions of the N audio objects. Thus, the downmix signals may be interpreted as audio objects having spatial positions which depend on the spatial positions of the N audio objects.

According to an example embodiment, the respective points in time defined by the transition data for the respective downmix metadata instances may coincide with the respective points in time defined by the transition data for corresponding side information instances. Employing the same points in time for beginning and for completing transitions associated with the side information and the downmix metadata facilitates joint processing, e.g. resampling, of the side information and the downmix metadata.

According to an example embodiment, the respective points in time defined by the transition data for the respective downmix metadata instances may coincide with the respective points in time defined by the transition data for corresponding cluster metadata instances. Employing the same points in time for beginning and ending transitions associated with the cluster metadata and the downmix metadata facilitates joint processing, e.g. resampling, of the cluster metadata and the downmix metadata.

According to example embodiments, there is provided an encoder for encoding N audio objects as a data stream, wherein $N>1$. The encoder comprises:

a downmix component configured to calculate M downmix signals, wherein $M \leq N$, by forming combinations of the N audio objects;

an analysis component configured to calculate time-variable side information including parameters which allow reconstruction of a set of audio objects formed on the basis of the N audio objects from the M downmix signals; and a multiplexing component configured to include the M downmix signals and the side information in a data stream for transmittal to a decoder, wherein the data stream corresponds to a plurality of time frames, wherein the multiplexing component is further configured to include, in the data stream, for transmittal to the decoder:

a plurality of side information instances specifying respective desired reconstruction settings for reconstructing the set of audio objects formed on the basis of the N audio objects; and for each side information instance, transition data including two independently assignable portions which in combination define a point in time to begin a transition from a current reconstruction setting to the desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame.

II. Overview—Decoder

According to a second aspect, there is provided a decoding method, a decoder, and a computer program product for decoding multichannel audio content.

The methods, decoders and computer program products according to the second aspect are intended for cooperation with the methods, encoders and computer program products according to the first aspect, and may have corresponding features and advantages.

According to example embodiments, there is provided a method for reconstructing audio objects based on a data stream. The method comprises:

receiving a data stream comprising M downmix signals which are combinations of N audio objects, wherein N>1 and M≤N, and time-variable side information including parameters which allow reconstruction of a set of audio objects formed on the basis of the N audio objects from the M downmix signals; and reconstructing, based on the M downmix signals and the side information, the set of audio objects formed on the basis of the N audio objects, wherein the data stream corresponds to a plurality of time frames, wherein the data stream comprises a plurality of side information instances, wherein the data stream further comprises, for each side information instance, transition data including two independently assignable portions which in combination define a point in time to begin a transition from a current reconstruction setting to a desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame; and and wherein reconstructing the set of audio objects formed on the basis of the N audio objects comprises:

performing reconstruction according to a current reconstruction setting;

beginning, at a point in time defined by the transition data for a side information instance, a transition from the current reconstruction setting to a desired reconstruction setting specified by the side information instance; and completing the transition at a point in time defined by the transition data for the side information instance.

As described above, employing a side information format which includes transition data defining points in time to begin and points in time to complete transitions from current reconstruction settings to respective desired reconstruction settings e.g. facilitates resampling of the side information.

The disclosed method for reconstructing audio objects based on a data stream allows for smooth interpolation between different reconstruction settings and may thus allow for an improved perceived quality of the reconstructed audio objects. More specifically, by allowing for transition periods such that the transition ends in a frame which may be subsequent to the frame in which the transition started, lossless reframing or resampling of the side information and thus the audio objects may be achieved. For example, if the objects are parametrically encoded into the data stream, the present method can maintain the synchronicity between the side information instances and the parametric description of the audio objects even in the case where reframing of the side information instances is performed. Furthermore, by allowing for transition periods such that the transition ends in a frame which may be subsequent to the frame in which the transition started, the required bit rate for transmitting the data stream to a encoder in an audio system may be reduced since the number of side information instances that need to be included in the data stream may be reduced. It should be noted that the data stream may for example be received in the form of a bitstream, e.g. generated on an encoder side.

Furthermore, the disclosed method may facilitate a more flexible syntax for allowing for reconstruction of audio objects.

The term "frame" should, in the context of the present specification, be understood to cover a certain time interval, and that no time frame overlaps another frame in time. E.g. a first frame covers the time interval [0, T[, a second frame, immediately subsequent to the first frame, covers the time interval [T, 2T[ etc. This means that the time T belongs the second frame and not to the first frame.

Further, it should be noted that the point in time defined by the transition data of a specific side information instance for beginning a transition corresponds to one frame, which means that if the point in time is 0.8T, it corresponds to the first frame according to above, and if the point in time is 1.3T, it corresponds to the second time frame. Moreover, even though the point in time defined by the transition data of a specific side information instance to complete the transition corresponds to a frame which may be subsequent to the frame in which the transition started, the side information instance is conveyed as a part of the bitstream in the frame to which the point in time for beginning the transition corresponds.

The term "subsequent to the first time frame" should, in the context of present specification, be understood to mean any time frame in the represented in the data stream which is later in time than the first time frame is subsequent to the first time frame. For example, a transition may start in frame one, continuing through frame two and end in frame three.

According to an example embodiment, for at least one of the plurality of side information instances, the second time frame is subsequent to the first time frame. Consequently, the transition ends in a frame which is subsequent to the frame in which the transition started. For example, if the transition started at 0.8T, the transition completed at a point in time which does not correspond to the same time frame, for example at T, 1.2T, 1.8T 2T 2.4T etc.

According to an example embodiment, the point in time defined by the transition data for beginning a transition is defined relative to a point in time where the corresponding time frame begins. Consequently, if the duration of a frame equals to T, the point in time where the transition begins can be defined by the interval [0, T[. By defining the point in time where the transition begins in this way, all of the plurality of side information instances can be defined using the same interval which allows more efficient coding of the side information instances and a more understandable syntax.

According to an example embodiment, for each specific time frame of the plurality of time frames there is zero or more corresponding side information instances in which the point in time defined by the transition data for beginning a transition corresponds to the specific time frame. This may reduce the required bit rate for transmitting the data stream to a decoder employing the disclosed method. Moreover, it may reduce the computational complexity of the decoder since it may not need to take into account a side information instance for each specific time frame when reconstructing the audio objects.

According to an example embodiment, if reconstruction is to be performed for a time frame for which there are zero side information instances, the method further comprises: if there is a transition defined by a side information instance corresponding to a previous time frame that is not completed, performing reconstruction based on the not completed transition, otherwise performing reconstruction according to the current reconstruction setting.

The present embodiment describes the scenario where no side information instances in the data stream for which the point in time defined by the transition data for beginning a transition correspond to the time frame to be reconstructed. In that case the reconstruction of the audio objects in that frame can be made according to the following. If there is an ongoing transition, e.g. a transition which begun in a previous time frame and which has not been completed yet, the reconstruction can be performed based on this not completed transition. If no such uncompleted transition exists, the reconstruction may be performed using the current reconstruction setting. The term "current reconstruction setting" should be understood to mean a reconstruction setting derived from the most recent side information instance received in any of the previous frames. This embodiment facilitates lossless resampling of the side information instances with a reduced computational complexity and/or a reduced required bit rate.

It should be noted that this embodiment may be used in the case where reconstruction is to be performed for a time frame for which none of the corresponding side information instances define a point in time for beginning a transition which directly corresponds to the first point in time of the frame. For example, if the frame covers the time interval [T, 2T[ and the only corresponding side information instance defines 1.4T as the point in time for beginning a transition. In that case, for the time interval [T, 1.4T[, the reconstruction can be made according to above.

Reconstructing, based on the M downmix signals and the side information, the set of audio objects formed on the basis of the N audio objects, may for example include forming at least one linear combination of the downmix signals employing coefficients determined based on the side information. Reconstructing, based on the M downmix signals and the side information, the set of audio objects formed on the basis of the N audio objects, may for example include forming linear combinations of the downmix signals, and, optionally one or more additional (e.g. decorrelated) signals derived from the downmix signals, employing coefficients determined based on the side information.

According to an example embodiment, the data stream may further comprise time-variable cluster metadata for the set of audio objects formed on the basis of the N audio objects, the cluster metadata including spatial positions for the set of audio objects formed on the basis of the N audio objects. The data stream may comprise a plurality of cluster metadata instances, and the data stream may further comprise, for each cluster metadata instance, transition data including two independently assignable portions which in combination define a point in time to begin a transition from a current rendering setting to a desired rendering setting specified by the cluster metadata instance, and a point in time to complete the transition to the desired rendering setting specified by the cluster metadata instance. The method may further comprise:

using the cluster metadata for rendering of the reconstructed set of audio objects formed on the basis of the N audio objects to output channels of a predefined channel configuration, the rendering comprising:

performing rendering according to a current rendering setting;

beginning, at a point in time defined by the transition data for a cluster metadata instance, a transition from the current rendering setting to a desired rendering setting specified by the cluster metadata instance; and completing the transition to the desired rendering setting at a point in time defined by the transition data for the cluster metadata instance.

The predefined channel configuration may for example correspond to a configuration of the output channels compatible with a particular playback system, i.e. suitable for playback on a particular playback system.

Rendering of the reconstructed set of audio objects formed on the basis of the N audio objects to output channels of a predefined channel configuration may for example include mapping, in a renderer, the reconstructed set of audio signals formed on the basis of the N audio objects to (a predefined configuration of) output channels of the renderer under control of the cluster metadata.

Rendering of the reconstructed set of audio objects formed on the basis of the N audio objects to output channels of a predefined channel configuration may for example include forming linear combinations of the reconstructed set of audio objects formed on the basis of the N audio objects, employing coefficients determined based on the cluster metadata.

According to an example embodiment, the respective points in time defined by the transition data for the respective cluster metadata instances may coincide with the respective points in time defined by the transition data for corresponding side information instances.

According to an example embodiment, the method may further comprise:

performing at least part of the reconstruction and at least part of the rendering as a combined operation corresponding to a first matrix formed as a matrix product of a reconstruction matrix and a rendering matrix associated with a current reconstruction setting and a current rendering setting, respectively;

beginning, at a point in time defined by the transition data for a side information instance and a cluster metadata instance, a combined transition from the current reconstruction and rendering settings to desired reconstruction and rendering settings specified by the side information instance and the cluster metadata instance, respectively; and completing the combined transition at a point in time defined by the transition data for the side information instance and the cluster metadata instance, wherein the combined transition includes interpolating between matrix elements of the first matrix and matrix elements of a second matrix formed as a matrix product of a reconstruction matrix and a rendering matrix associated with the desired reconstruction setting and the desired rendering setting, respectively.

By performing a combined transition in the above sense, instead of separate transitions of reconstruction settings and rendering settings, fewer parameters/coefficients need to be interpolated, which allows for a reduction of computational complexity.

It is to be understood that a matrix, such as reconstruction matrix or a rendering matrix, as referenced in the present example embodiment, may for example consist of a single row or a single column, and may therefore correspond to a vector.

Reconstruction of audio objects from downmix signals is often performed by employing different reconstruction matrices in different frequency bands, while rendering is often performed by employing the same rendering matrix for all frequencies. In such cases, a matrix corresponding to a combined operation of reconstruction and rendering, e.g. the first and second matrices referenced in the present example embodiment, may typically be frequency-dependent, i.e. different values for the matrix elements may typically be employed for different frequency bands.

According to an example embodiment, the set of audio objects formed on the basis of the N audio objects may coincide with the N audio objects, i.e. the method may comprise reconstructing the N audio objects based on the M downmix signals and the side information.

Alternatively, the set of audio objects formed on the basis of the N audio objects may comprise a plurality of audio objects which are combinations of the N audio objects, and whose number is less than N, i.e. the method may comprise reconstructing these combinations of the N audio objects based on the M downmix signals and the side information.

According to an example embodiment, the data stream may further comprise downmix metadata for the M downmix signals including time-variable spatial positions associated with the M downmix signals. The data stream may comprise a plurality of downmix metadata instances, and the data stream may further comprise, for each downmix metadata instance, transition data including two independently assignable portions which in combination define a point in time to begin a transition from a current downmix rendering setting to a desired downmix rendering setting specified by the downmix metadata instance, and a point in time to complete the transition to the desired downmix rendering setting specified by the downmix metadata instance. The method may further comprise:

on a condition that the decoder is operable (or configured) to support audio object reconstruction, performing the step of reconstructing, based on the M downmix signals and the side information, the set of audio objects formed on the basis of the N audio objects; and on a condition that the decoder is not operable (or configured) to support audio object reconstruction, outputting the downmix metadata and the M downmix signals for rendering of the M downmix signals.

In case the decoder is operable to support audio object reconstruction and the data stream further comprises cluster metadata associated with the set of audio objects formed on the basis of the N audio objects, the decoder may e.g. output the reconstructed set of audio objects and the cluster metadata for rendering of the reconstructed set of audio objects.

In case the decoder is not operable to support audio object reconstruction, it may for example discard the side information and, if applicable, the cluster metadata, and provide the downmix metadata and the M downmix signals as output. Then, the output may be employed by a renderer for rendering the M downmix signals to output channels of the renderer.

Optionally, the method may further comprise rendering the M downmix signals to output channels of a predefined output configuration, e.g. to output channels of a renderer, or to output channels of the decoder (in case the decoder has rendering capabilities), based on the downmix metadata.

According to example embodiments, there is provided a decoder for reconstructing audio objects based on a data stream. The decoder comprises:

a receiving component configured to receive a data stream comprising M downmix signals which are combinations of N audio objects, wherein $N>1$ and $M\leq N$, and time-variable side information including parameters which allow reconstruction of a set of audio objects formed on the basis of the N audio objects from the M downmix signals; and a reconstructing component configured to reconstruct, based on the M downmix signals and the side information, the set of audio objects formed on the basis of the N audio objects, wherein the data stream comprises a plurality of side information instances associated, and wherein the data stream further comprises, for each side information instance, transition data including two independently assignable portions which in combination define a point in time to begin a transition from a current reconstruction setting to a desired reconstruction setting specified by the side information instance, and a point in time to complete the transition. The reconstructing component is configured to reconstruct the set of audio objects formed on the basis of the N audio objects by at least:

performing reconstruction according to a current reconstruction setting;

beginning, at a point in time defined by the transition data for a side information instance, a transition from the current reconstruction setting to a desired reconstruction setting specified by the side information instance; and completing the transition at a point in time defined by the transition data for the side information instance.

According to an example embodiment, the method within the first or second aspect may further comprise generating one or more additional side information instances specifying substantially the same reconstruction setting as a side information instance directly preceding or directly succeeding the one or more additional side information instances. Example embodiments are also envisaged in which additional cluster metadata instances and/or downmix metadata instances are generated in an analogous fashion.

As described above, resampling of the side information by generating more side information instances may be advantageous in several situations, such as when audio signals/objects and associated side information are encoded using a frame-based audio codec, since then it is desirable to have at least one side information instance for each audio codec frame. At an encoder side, the side information instances provided by an analysis component may e.g. be distributed in time in such a way that they do not match a frame rate of the downmix signals provided by a downmix component, and the side information may therefore advantageously be resampled by introducing new side information instances such that there is at least one side information instance for each frame of the downmix signals. Similarly, at a decoder side, the received side information instances may e.g. be distributed in time in such a way that they do not match a frame rate of the received downmix signals, and the side information may therefore advantageously be resampled by introducing new side information instances such that there is at least one side information instance for each frame of the downmix signals.

An additional side information instance may for example be generated for a selected point in time by: copying the side information instance directly succeeding the additional side information instance and determining transition data for the additional side information instance based on the selected point in time and the points in time defined by the transition data for the succeeding side information instance.

III. Overview—Transcoder

According to a third aspect, there is provided a method, a device, and a computer program product for transcoding side information encoded together with M audio signals in a data stream.

The methods, devices and computer program products according to the third aspect are intended for cooperation with the methods, encoders, decoder and computer program products according to the first and second aspect, and may have corresponding features and advantages.

According to example embodiments, there is provided a method for transcoding side information encoded together with M audio signals in a data stream. The method comprises:

receiving a data stream corresponding to a plurality of time frames;

extracting, from the data stream, M audio signals and associated time-variable side information including parameters which allow reconstruction of a set of audio objects from the M audio signals, wherein $M \geq 1$, and wherein the extracted side information includes:

a plurality of side information instances specifying respective desired reconstruction settings for reconstructing the audio objects, and for each side information instance, transition data including two independently assignable portions which in combination define a point in time to begin a transition from a current reconstruction setting to the desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame;

generating one or more additional side information instances specifying substantially the same reconstruction setting as a side information instance directly preceding or directly succeeding the one or more additional side information instances; and including the M audio signals and the side information in a transcoded data stream.

In the present example embodiment, the one or more additional side information instances may be generated after the side information has been extracted from the received data stream, and the generated one or more additional side information instances may then be included in a data stream together with the M audio signals and the other side information instances.

As described above in relation to the first aspect, resampling of the side information by generating more side information instances may be advantageous in several situations, such as when audio signals/objects and associated side information are encoded using a frame-based audio codec, since then it is desirable to have at least one side information instance for each audio codec frame.

According to example embodiments, for at least one of the plurality of side information instances, the second time frame is subsequent to the first time frame.

According to example embodiments, the point in time defined by the transition data for beginning a transition is defined relative to a point in time where the corresponding frame begins.

Embodiments are also envisaged in which the data stream further comprises cluster metadata and/or downmix metadata, as described in relation to the first and second aspect, and wherein the method further comprises generating additional downmix metadata instances and/or cluster metadata instances, analogously to how the additional side information instances are generated.

According to an example embodiment, the M audio signals may be coded in the received data stream according to a first frame rate, and the method may further comprise:

processing the M audio signals to change the frame rate according to which the M downmix signals are coded to a second frame rate different than the first frame rate; and resampling the side information to match, and/or to be compatible with, the second frame rate, such that the transcoded bitstream comprises a plurality of time frames according to the second frame rate, wherein for a specific time frame of the plurality of time frames in the transcoded bitstream, there are zero corresponding side information instances, wherein for that specific time frame the resampling comprises generating an additional side information instance out of the one or more additional side information instances by: if there is a transition defined by a side information instance corresponding to a previous time frame in the transcoded bitstream that is not completed for a point in time where the specific time frame begins, generating the additional side information instance by copying the side information instance corresponding to the previous frame and modifying the point in time to begin a transition to a point in time where the time frame begins.

According to other embodiments, if for a specific time frame of the plurality of time frames in the transcoded bitstream as described above, there are zero corresponding side information instances and if there is no transition defined by a side information instance corresponding to a previous time frame in the transcoded bitstream that is not completed for a point in time where the specific time frame begins, an additional side information instance is generated by copying the side information instance corresponding to the previous frame and modifying the point in time to begin a transition to a point in time where the time frame begins, and modifying the point in time for completing a transition to the point in time where the time frame begins.

As described above in relation to the first aspect, it may be advantageous in several situations to process audio signals so as to change the frame rate employed for coding them, e.g. so that the modified frame rate matches the frame rate of video content of an audio-visual signal to which the audio signals belong. The presence of the transition data for each side information instance facilitates resampling of the side information, as described above in relation to the first aspect. The side information may be resampled to match the new frame rate e.g. by generating additional side information instances such that there is at least one side information instance for each frame of the processed audio signals. With the present embodiment, a lossless reframing may be achieved.

As also described above in relation to the first aspect, the term "for a specific time frame of the plurality of time frames in the transcoded bitstream, there are zero corresponding side information instances" should be understood to mean that no side information instance exists corresponding to the specific time frame before the additional side information instance is generated.

Moreover, by modifying the point in time for completing a transition to the point in time where the time frame begins, the duration of the transition is set to zero, which means that no transition will be done. But by including such additional side information instance in the bitstream, a correct reconstruction setting will be included in the transcoded bitstream for the discussed time frame.

According to example embodiments, there is provided a device for transcoding side information encoded together with M audio signals in a data stream. The device comprises:

a receiving component configured to receive a data stream and to extract, from the data stream, M audio signals and associated time-variable side information including parameters which allow reconstruction of a set of audio objects from the M audio signals, wherein and wherein the extracted side information includes:

a plurality of side information instances specifying respective desired reconstruction settings for reconstructing the audio objects, and for each side information instance, transition data including two independently assignable portions which in combination define a point in time to begin a transition from a current reconstruction setting to the desired reconstruction setting specified by the side information instance, and a point in time to complete the transition, and wherein for each specific side information instance of the plurality of side information instances: the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame.

The device further comprises:

a resampling component configured to generate one or more additional side information instances specifying substantially the same reconstruction setting as a side information instance directly preceding or directly succeeding the one or more additional side information instances; and a multiplexing component configured to include the M audio signals and the side information in a data stream.

According to an example embodiment, the method within the first, second or third aspect may further comprise: computing a difference between a first desired reconstruction setting specified by a first side information instance and one or more desired reconstruction settings specified by one or more side information instances directly succeeding the first side information instance; and removing the one or more side information instances in response to the computed difference being below a predefined threshold. Example embodiments are also envisaged in which cluster metadata instances and/or downmix metadata instances are removed in an analogous fashion.

By removing side information instances according to the present example embodiment, unnecessary computations based on these side information instances may be avoided, e.g. during reconstruction at a decoder side. By setting the predefined threshold at an appropriate (e.g. low enough) level, side information instances may be removed while the playback quality and/or the fidelity of the reconstructed audio signals is at least approximately maintained.

The difference between the desired reconstruction settings may for example be computed based on differences between respective values for a set of coefficients employed as part of the reconstruction.

According to example embodiments within the first, second or third aspect, the two independently assignable portions of the transition data for each side information instance may be:

a time stamp indicating the point in time to begin the transition to the desired reconstruction setting and a time stamp indicating the point in time to complete the transition to the desired reconstruction setting;

a time stamp indicating the point in time to begin the transition to the desired reconstruction setting and an interpolation duration parameter indicating a duration for reaching the desired reconstruction setting from the point in time to begin the transition to the desired reconstruction setting; or a time stamp indicating the point in time to complete the transition to the desired reconstruction setting and an interpolation duration parameter indicating a duration for reaching the desired reconstruction setting from the point in time to begin the transition to the desired reconstruction setting.

In other words, the points in time to start and to end a transition may be defined in the transition data either by two time stamps indicating the respective points in time, or a combination of one of the time stamps and an interpolation duration parameter indicating a duration of the transition.

The respective time stamps may for example indicate the respective points in time by referring to a time base employed for representing the M downmix signals and/or the N audio objects.

According to example embodiments within the first, second or third aspect, the two independently assignable portions of the transition data for each cluster metadata instance may be:

a time stamp indicating the point in time to begin the transition to the desired rendering setting and a time stamp indicating the point in time to complete the transition to the desired rendering setting;

a time stamp indicating the point in time to begin the transition to the desired rendering setting and an interpolation duration parameter indicating a duration for reaching the desired rendering setting from the point in time to begin the transition to the desired rendering setting; or a time stamp indicating the point in time to complete the transition to the desired rendering setting and an interpolation duration parameter indicating a duration for reaching the desired rendering setting from the point in time to begin the transition to the desired rendering setting.

According to example embodiments within the first, second or third aspect, the two independently assignable portions of the transition data for each downmix metadata instance may be:

a time stamp indicating the point in time to begin the transition to the desired downmix rendering setting and a time stamp indicating the point in time to complete the transition to the desired downmix rendering setting;

a time stamp indicating the point in time to begin the transition to the desired downmix rendering setting and an interpolation duration parameter indicating a duration for reaching the desired downmix rendering setting from the point in time to begin the transition to the desired downmix rendering setting; or a time stamp indicating the point in time to complete the transition to the desired downmix rendering setting and an interpolation duration parameter indicating a duration for reaching the desired downmix rendering setting from the point in time to begin the transition to the desired downmix rendering setting.

According to example embodiments, there is provided a computer program product comprising a computer-readable medium with instructions for performing the method of any of the methods within the first, second or third aspect.

IV. Example Embodiments

FIG. 1 illustrates an encoder 100 for encoding audio objects 120 into a data stream 140 according to an exemplary embodiment. The encoder 100 comprises a receiving component (not shown), a downmix component 102, an encoder component 104, an analysis component 106, and a multiplexing component 108. The operation of the encoder 100 for encoding one time frame of audio data is described in the following. However, it is understood that the below method is repeated on a time frame basis. The same also applies to the description of FIGS. 2-5.

The receiving component receives a plurality of audio objects (N audio objects) 120 and metadata 122 associated with the audio objects 120. An audio object as used herein refers to an audio signal having an associated spatial position which typically is varying with time (between time frames), i.e. the spatial position is dynamic. The metadata 122 associated with the audio objects 120 typically comprises information which describes how the audio objects 120 are to be rendered for playback on the decoder side. In particular, the metadata 122 associated with the audio objects 120 includes information about the spatial position of the audio objects 120 in the three-dimensional space of the audio scene. The spatial positions can be represented in Cartesian coordinates or by means of direction angles, such as azimuth and elevation, optionally augmented with distance. The metadata 122 associated with the audio objects 120 may further comprise object size, object loudness, object importance, object content type, specific rendering instructions such as application of dialog enhancement or exclusion of certain loudspeakers from rendering (so-called zone masks) and/or other object properties.

As will be described with reference to FIG. 4, the audio objects 120 may correspond to a simplified representation of an audio scene.

The N audio objects 120 are input to the downmix component 102. The downmix component 102 calculates a number M of downmix signals 124 by forming combinations, typically linear combinations, of the N audio objects 120. In most cases, the number of downmix signals 124 is lower than the number of audio objects 120, i.e. $M<N$, such that the amount of data that is included in the data stream 140 is reduced. However, for applications where the target bit rate of the data stream 140 is high, the number of downmix signals 124 may be equal to the number of objects 120, i.e. $M=N$.

The downmix component 102 may further calculate one or more auxiliary audio signals 127, here labeled by L auxiliary audio signals 127. The role of the auxiliary audio signals 127 is to improve the reconstruction of the N audio objects 120 at the decoder side. The auxiliary audio signals 127 may correspond to one or more of the N audio objects 120, either directly or as a combination of these. For example, the auxiliary audio signals 127 may correspond to particularly important ones of the N audio objects 120, such as an audio object 120 corresponding to a dialogue. The importance may be reflected by or derived from the metadata 122 associated with the N audio objects 120.

The M downmix signals 124, and the L auxiliary signals 127 if present, may subsequently be encoded by the encoder component 104, here labeled core encoder, to generate M encoded downmix signals 126 and L encoded auxiliary signals 129. The encoder component 104 may be a perceptual audio codec as known in the art. Examples of known perceptual audio codecs include Dolby Digital and MPEG AAC.

In some embodiments, the downmix component 102 may further associate the M downmix signals 124 with metadata 125. In particular, downmix component 102 may associate each downmix signal 124 with a spatial position and include the spatial position in the metadata 125. Similar to the metadata 122 associated with the audio objects 120, the metadata 125 associated with the downmix signals 124 may also comprise parameters related to size, loudness, importance, and/or other properties.

In particular, the spatial positions associated with the downmix signals 124 may be calculated based on the spatial positions of the N audio objects 120. Since the spatial positions of the N audio objects 120 may be dynamic, i.e. time-varying, also the spatial positions associated with the M downmix signals 124 may be dynamic. In other words, the M downmix signals 124 may themselves be interpreted as audio objects.

The analysis component 106 calculates side information 128 including parameters which allow reconstruction of the N audio objects 120 (or a perceptually suitable approximation of the N audio objects 120) from the M downmix signals 124 and the L auxiliary signals 129 if present. Also the side information 128 may be time-variable. For example, the analysis component 106 may calculate the side information 128 by analyzing the M downmix signals 124, the L auxiliary signals 127 if present, and the N audio objects 120 according to any known technique for parametric encoding. Alternatively, the analysis component 106 may calculate the side information 128 by analyzing the N audio objects, and information on how the M downmix signals were created from the N audio objects, for example by providing a (time-varying) downmix matrix. In that case, the M downmix signals 124 are not strictly required as an input to the analysis component 106.

The M encoded downmix signals 126, the L encoded auxiliary signals 129, the side information 128, the metadata 122 associated with the N audio objects, and the metadata 125 associated with the downmix signals are then input to the multiplexing component 108 which includes its input data in a single data stream 140 using multiplexing techniques. The data stream 140 may thus include four types of data:

a) M downmix signals 126 (and optionally L auxiliary signals 129)
b) metadata 125 associated with the M downmix signals,
c) side information 128 for reconstruction of the N audio objects from the M downmix signals, and
d) metadata 122 associated with the N audio objects.

As mentioned above, some prior art systems for coding of audio objects requires that the M downmix signals are chosen such that they are suitable for playback on the channels of a speaker configuration with M channels, referred to herein as a backwards compatible downmix. Such a prior art requirement constrains the calculation of the downmix signals in that the audio objects may only be combined in a predefined manner. Accordingly, according to prior art, the downmix signals are not selected from the point of view of optimizing the reconstruction of the audio objects at a decoder side.

As opposed to prior art systems, the downmix component 102 calculates the M downmix signals 124 in a signal adaptive manner with respect to the N audio objects. In particular, the downmix component 102 may, for each time frame, calculate the M downmix signals 124 as the combination of the audio objects 120 that currently optimizes some criterion. The criterion is typically defined such that it is independent with respect to a any loudspeaker configuration, such as a 5.1 or other loudspeaker configuration. This implies that the M downmix signals 124, or at least one of them, are not constrained to audio signals which are suitable for playback on the channels of a speaker configuration with M channels. Accordingly, the downmix component 102 may adapt the M downmix signals 124 to the temporal variation of the N audio objects 120 (including temporal variation of the metadata 122 including spatial positions of the N audio objects), in order to e.g. improve the reconstruction of the audio objects 120 at the decoder side.

The downmix component 102 may apply different criteria in order to calculate the M downmix signals. According to one example, the M downmix signals may be calculated such that the reconstruction of the N audio objects based on the M downmix signals is optimized. For example, the downmix component 102 may minimize a reconstruction error formed from the N audio objects 120 and a reconstruction of the N audio objects based on the M downmix signals 124.

According to another example, the criterion is based on the spatial positions, and in particular spatial proximity, of the N audio objects 120. As discussed above, the N audio objects 120 have associated metadata 122 which includes the spatial positions of the N audio objects 120. Based on the metadata 122, spatial proximity of the N audio objects 120 may be derived.

In more detail, the downmix component 102 may apply a first clustering procedure in order to determine the M downmix signals 124. The first clustering procedure may comprise associating the N audio objects 120 with M clusters based on spatial proximity. Further properties of the N audio objects 120 as represented by the associated metadata 122, including object size, object loudness, object importance, may also be taken into account during the association of the audio objects 120 with the M clusters.

According to one example, the well-known K-means algorithm, with the metadata 122 (spatial positions) of the N audio objects as input, may be used for associating the N audio objects 120 with the M clusters based on spatial proximity. The further properties of the N audio objects 120 may be used as weighting factors in the K-means algorithm.

According to another example, the first clustering procedure may be based on a selection procedure which uses the importance of the audio objects, as given by the metadata 122, as a selection criterion. In more detail, the downmix component 102 may pass through the most important audio objects 120 such that one or more of the M downmix signals correspond to one or more of the N audio objects 120. The remaining, less important, audio objects may be associated with clusters based on spatial proximity as discussed above.

Further examples of clustering of audio objects are given in U.S. provisional application with No. 61/865,072 or subsequent applications claiming the priority of that application.

According to yet another example, the first clustering procedure may associate an audio object 120 with more than one of the M clusters. For example an audio object 120 may be distributed over the M clusters, wherein the distribution e.g. depends on the spatial position of the audio object 120 and optionally also further properties of the audio object including object size, object loudness, object importance, etc. The distribution may be reflected by percentages, such that an audio object for instance is distributed over three clusters according to the percentages 20%, 30%, 50%.

Once the N audio objects 120 have been associated with the M clusters, the downmix component 102 calculates a downmix signal 124 for each cluster by forming a combination, typically a linear combination, of the audio objects 120 associated with the cluster. Typically, the downmix component 102 may use parameters comprised in the metadata 122 associated with audio objects 120 as weights when forming the combination. By way of example, the audio objects 120 being associated with a cluster may be weighted according to object size, object loudness, object importance, object position, distance from an object with respect to a spatial position associated with the cluster (see details in the following) etc. In the case where the audio objects 120 are distributed over the M clusters, the percentages reflecting the distribution may be used as weights when forming the combination.

The first clustering procedure is advantageous in that it easily allows association of each of the M downmix signals 124 with a spatial position. For example, the downmix component 120 may calculate a spatial position of a downmix signal 124 corresponding to a cluster based on the spatial positions of the audio objects 120 associated with the cluster. The centroid or a weighted centroid of the spatial positions of the audio objects being associated with the cluster may be used for this purpose. In case of a weighted centroid, the same weights may be used as when forming the combination of the audio objects 120 associated with the cluster.

Figure 2:
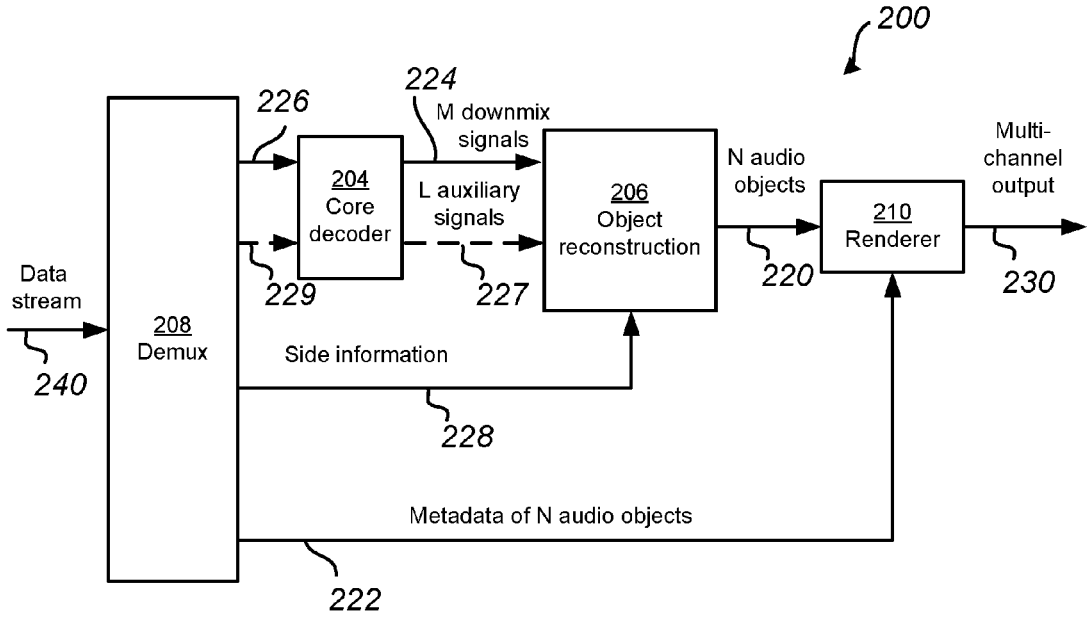
FIG. 2 is a schematic illustration of a decoder which supports reconstruction of audio objects according to exemplary embodiments.

FIG. 2 illustrates a decoder 200 corresponding to the encoder 100 of FIG. 1. The decoder 200 is of the type that supports audio object reconstruction. The decoder 200 comprises a receiving component 208, a decoder component 204, and a reconstruction component 206. The decoder 200 may further comprise a renderer 210. Alternatively, the decoder 200 may be coupled to a renderer 210 which forms part of a playback system.

The receiving component 208 is configured to receive a data stream 240 from the encoder 100. The receiving component 208 comprises a demultiplexing component configured to demultiplex the received data stream 240 into its components, in this case M encoded downmix signals 226, optionally L encoded auxiliary signals 229, side information 228 for reconstruction of N audio objects from the M downmix signals and the L auxiliary signals, and metadata 222 associated with the N audio objects.

The decoder component 204 processes the M encoded downmix signals 226 to generate M downmix signals 224, and optionally L auxiliary signals 227. As further discussed above, the M downmix signals 224 were formed adaptively on the encoder side from the N audio objects, i.e. by forming combinations of the N audio objects according to a criterion which is independent of any loudspeaker configuration.

The object reconstruction component 206 then reconstructs the N audio objects 220 (or a perceptually suitable approximation of these audio objects) based on the M downmix signals 224 and optionally the L auxiliary signals 227 guided by the side information 228 derived on the encoder side. The object reconstruction component 206 may apply any known technique for such parametric reconstruction of the audio objects.

The reconstructed N audio objects 220 are then processed by the renderer 210 using the metadata 222 associated with the audio objects 220 and knowledge about the channel configuration of the playback system in order to generate an multichannel output signal 230 suitable for playback. Typical speaker playback configurations include 22.2 and 11.1. Playback on soundbar speaker systems or headphones (binaural presentation) is also possible with dedicated renderers for such playback systems.

Figure 3:
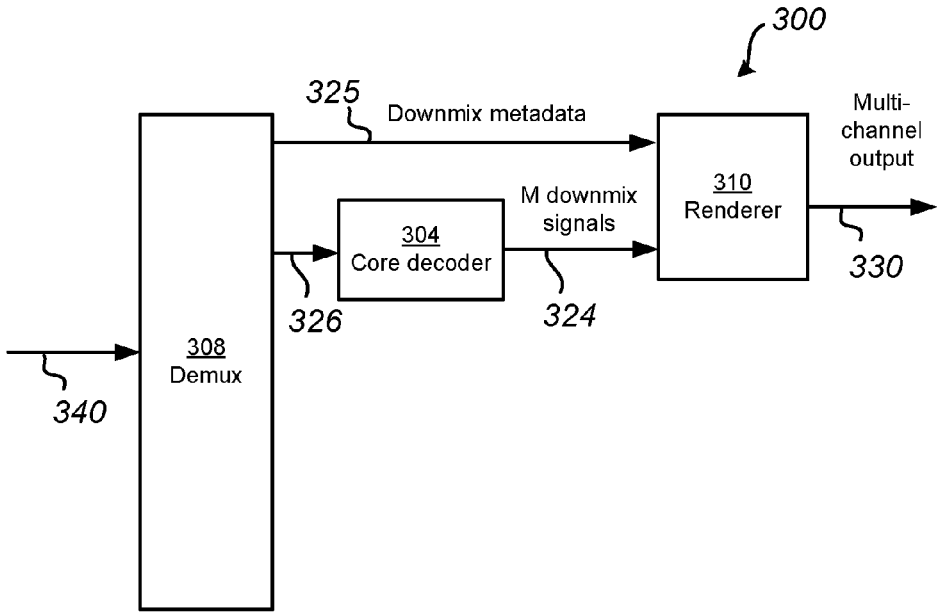
FIG. 3 is a schematic illustration of a low-complexity decoder which does not support reconstruction of audio objects according to exemplary embodiments.

FIG. 3 illustrates a low-complexity decoder 300 corresponding to the encoder 100 of FIG. 1. The decoder 300 does not support audio object reconstruction. The decoder 300 comprises a receiving component 308, and a decoding component 304. The decoder 300 may further comprise a renderer 310. Alternatively, the decoder is coupled to a renderer 310 which forms part of a playback system.

As discussed above, prior art systems which use a backwards compatible downmix (such as a 5.1 downmix), i.e. a downmix comprising M downmix signals which are suitable for direct playback on a playback system with M channels, easily enable low complexity decoding for legacy playback systems (that e.g. only support a 5.1 multichannel loudspeaker setup). Such prior art systems typically decodes the backwards compatible downmix signals themselves and discards additional parts of the data stream such as side information (cf. item 228 of FIG. 2) and metadata associated with the audio objects (cf. item 222 of FIG. 2). However, when the downmix signals are formed adaptively as described above, the downmix signals are generally not suitable for direct playback on a legacy system.

The decoder 300 is an example of a decoder which allows low-complexity decoding of M downmix signals which are adaptively formed for playback on a legacy playback system which only supports a particular playback configuration.

The receiving component 308 receives a bit stream 340 from an encoder, such as encoder 100 of FIG. 1. The receiving component 308 demultiplexes the bit stream 340 into its components. In this case, the receiving component 308 will only keep the encoded M downmix signals 326 and the metadata 325 associated with the M downmix signals. The other components of the data stream 340, such as the L auxiliary signals (cf. item 229 of FIG. 2) metadata associated with the N audio objects (cf. item 222 of FIG. 2) and the side information (cf. item 228 of FIG. 2) are discarded.

The decoding component 304 decodes the M encoded downmix signals 326 to generate M downmix signals 324. The M downmix signals are then, together with the downmix metadata, input to the renderer 310 which renders the M downmix signals to a multichannel output 330 corresponding to a legacy playback format (which typically has M channels). Since the downmix metadata 325 comprises spatial positions of the M downmix signals 324, the renderer 310 may typically be similar to the renderer 210 of FIG. 2, with the only difference that the renderer 310 now takes the M downmix signals 324 and the metadata 325 associated with the M downmix signals 324 as input instead of audio objects 220 and their associated metadata 222.

As mentioned above in connection to FIG. 1, the N audio objects 120 may correspond to a simplified representation of an audio scene.

Generally, an audio scene may comprise audio objects and audio channels. By an audio channel is here meant an audio signal which corresponds to a channel of a multichannel speaker configuration. Examples of such multichannel speaker configurations include a 22.2 configuration, a 11.1 configuration etc. An audio channel may be interpreted as a static audio object having a spatial position corresponding to the speaker position of the channel.

In some cases the number of audio objects and audio channels in the audio scene may be vast, such as more than 100 audio objects and 1-24 audio channels. If all of these audio objects/channels are to be reconstructed on the decoder side, a lot of computational power is required. Furthermore, the resulting data rate associated with object metadata and side information will generally be very high if many objects are provided as input. For this reason it is advantageous to simplify the audio scene in order to reduce the number of audio objects to be reconstructed on the decoder side. For this purpose, the encoder may comprise a clustering component which reduces the number of audio objects in the audio scene based on a second clustering procedure. The second clustering procedure aims at exploiting the spatial redundancy present in the audio scene, such as audio objects having equal or very similar locations. Additionally, perceptual importance of audio objects may be taken into account. Generally, such a clustering component may be arranged in sequence or in parallel with the downmix component 102 of FIG. 1. The sequential arrangement will be described with reference to FIG. 4 and the parallel arrangement will be described with reference to FIG. 5.

Figure 4:
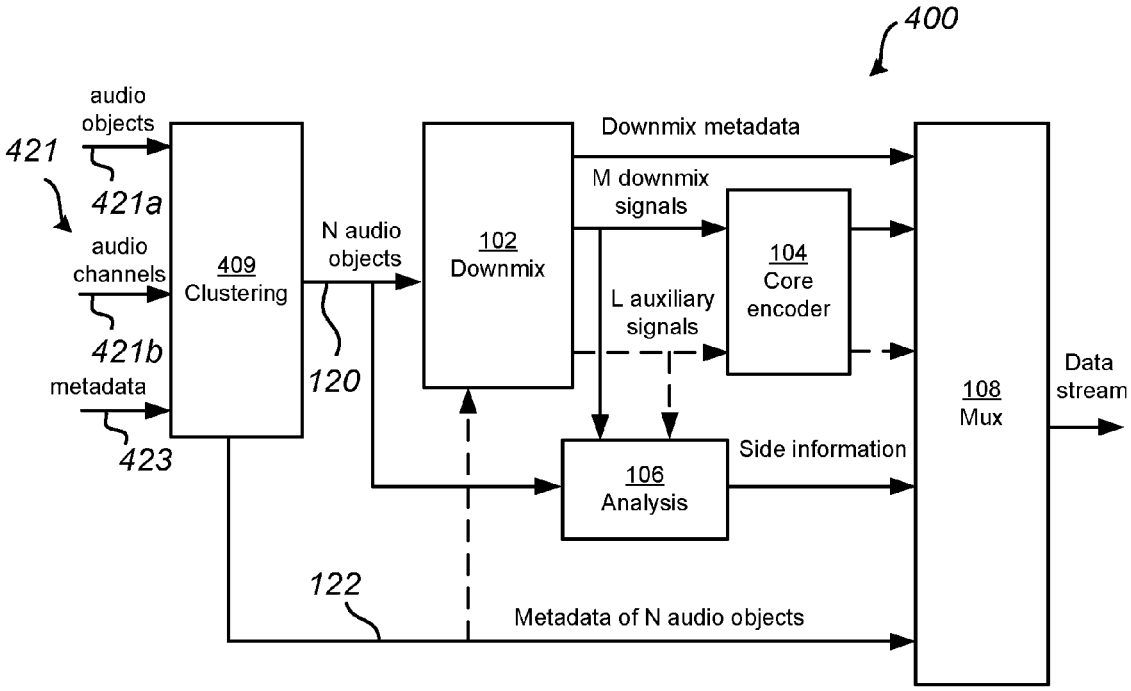
FIG. 4 is a schematic illustration of an encoder which comprises a sequentially arranged clustering component for simplification of an audio scene according to exemplary embodiments.

FIG. 4 illustrates an encoder 400. In addition to the components described with reference to FIG. 1, the encoder 400 comprises a clustering component 409. The clustering component 409 is arranged in sequence with the downmix component 102, meaning that the output of the clustering component 409 is input to the downmix component 102.

The clustering component 409 takes audio objects 421*a* and/or audio channels 421*b* as input together with associated metadata 423 including spatial positions of the audio objects 421*a*. The clustering component 409 converts the audio channels 421*b* to static audio objects by associating each audio channel 421*b* with the spatial position of the speaker position corresponding to the audio channel 421*b*. The audio objects 421*a* and the static audio objects formed from the audio channels 421*b* may be seen as a first plurality of audio objects 421.

The clustering component 409 generally reduces the first plurality of audio objects 421 to a second plurality of audio objects, here corresponding to the N audio objects 120 of FIG. 1. For this purpose the clustering component 409 may apply a second clustering procedure.

The second clustering procedure is generally similar to the first clustering procedure described above with respect to the downmix component 102. The description of the first clustering procedure therefore also applies to the second clustering procedure.

In particular, the second clustering procedure involves associating the first plurality of audio objects 421 with at least one cluster, here N clusters, based on spatial proximity of the first plurality of audio objects 421. As further described above, the association with clusters may also be based on other properties of the audio objects as represented by the metadata 423. Each cluster is then represented by an object which is a (linear) combination of the audio objects associated with that cluster. In the illustrated example, there are N clusters and hence N audio objects 120 are generated. The clustering component 409 further calculates metadata 122 for the so generated N audio objects 120. The metadata 122 includes spatial positions of the N audio objects 120. The spatial position of each of the N audio objects 120 may be calculated based on the spatial positions of the audio objects associated with the corresponding cluster. By way of example the spatial position may be calculated as a centroid or a weighted centroid of the spatial positions of the audio objects associated with the cluster as further explained above with reference to FIG. 1.

The N audio objects 120 generated by the clustering component 409 are then input to the downmix component 120 as further described with reference to FIG. 1.

Figure 5:
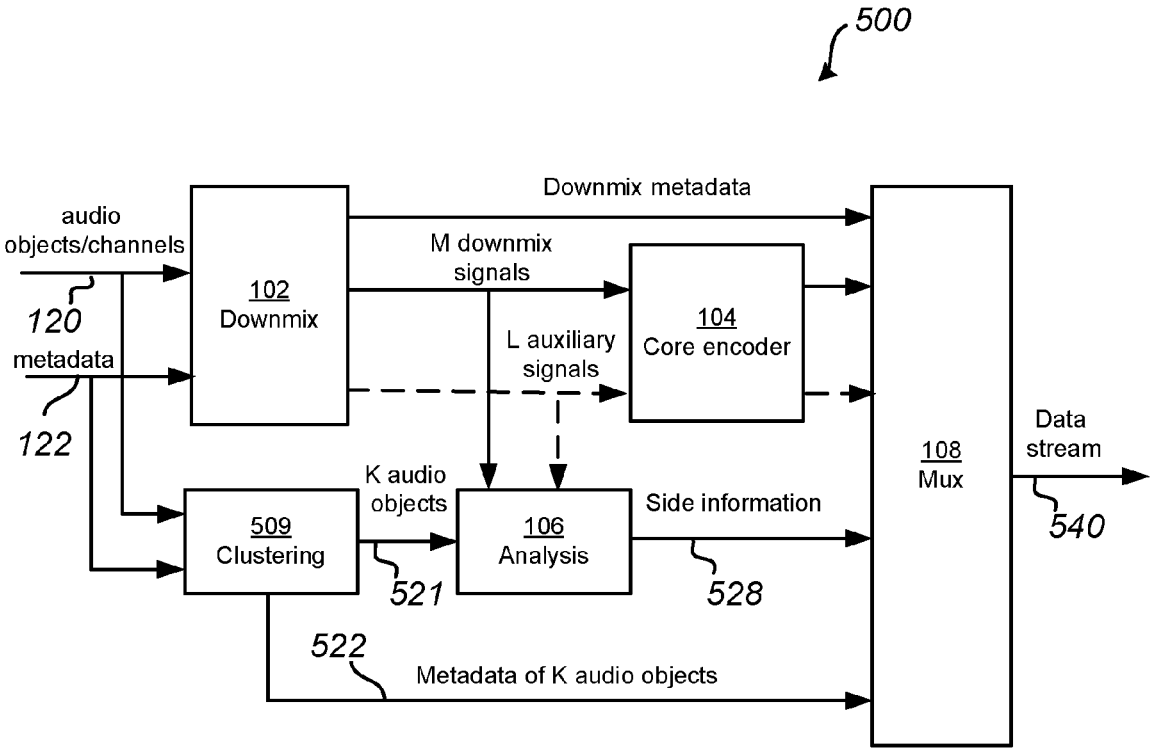
FIG. 5 is a schematic illustration of an encoder which comprises a clustering component arranged in parallel for simplification of an audio scene according to exemplary embodiments.

FIG. 5 illustrates an encoder 500. In addition to the components described with reference to FIG. 1, the encoder 500 comprises a clustering component 509. The clustering component 509 is arranged in parallel with the downmix component 102, meaning that the downmix component 102 and the clustering component 509 have the same input.

The input comprises a first plurality of audio objects, corresponding to the N audio objects 120 of FIG. 1, together with associated metadata 122 including spatial positions of the first plurality of audio objects. The first plurality of audio objects 120 may, similar to the first plurality of audio objects 421 of FIG. 4, comprise audio objects and audio channels being converted into static audio objects. In contrast to the sequential arrangement of FIG. 4 where the downmix component 102 operates on a reduced number of audio objects corresponding to a simplified version of the audio scene, the downmix component 102 of FIG. 5 operates on the full audio content of the audio scene in order to generate M downmix signals 124.

The clustering component 509 is similar in functionality to the clustering component 409 described with reference to FIG. 4. In particular, the clustering component 509 reduces the first plurality of audio objects 120 to a second plurality of audio objects 521, here illustrated by K audio objects where typically $M<K<N$ (for high bit applications $M\leq K\leq N$), by applying the second clustering procedure described above. The second plurality of audio objects 521 is thus a set of audio objects formed on basis of the N audio objects 120. Moreover the clustering component 509 calculates metadata 522 for the second plurality of audio objects 521 (the K audio objects) including spatial positions of the second plurality of audio objects 521. The metadata 522 is included in the data stream 540 by the multiplexing component 108. The analysis component 106 calculates side information 528 which enables reconstruction of second plurality of audio objects 521, i.e. the set of audio objects formed on basis of the N audio objects (here the K audio objects), from the M downmix signals 124. The side information 528 is included in the data stream 540 by the multiplexing component 108. As further discussed above, the analysis component 106 may for example derive the side information 528 by analyzing the second plurality of audio objects 521 and the M downmix signals 124.

The data stream 540 generated by the encoder 500 may generally be decoded by the decoder 200 of FIG. 2 or the decoder 300 of FIG. 3. However, the reconstructed audio objects 220 of FIG. 2 (labeled N audio objects) now correspond to the second plurality of audio objects 521 (labeled K audio objects) of FIG. 5, and the metadata 222 associated with the audio objects (labeled metadata of N audio objects) now correspond to the metadata 522 of the second plurality of audio objects (labeled metadata of K audio objects) of FIG. 5.

In object-based audio encoding/decoding systems, side information or metadata associated with the objects is typically updated relatively infrequently (sparsely) in time to limit the associated data rate. Typical update intervals for object positions can range between 10 and 500 milliseconds, depending on the speed of the object, the required position accuracy, the available bandwidth to store or transmit metadata, etc. Such sparse, or even irregular metadata updates require interpolation of metadata and/or rendering matrices (i.e. matrices employed in rendering) for audio samples in-between two subsequent metadata instances. Without interpolation, the consequential step-wise changes in the rendering matrix may cause undesirable switching artifacts, clicking sounds, zipper noises, or other undesirable artifacts as a result of spectral splatter introduced by step-wise matrix updates.

Figure 6:
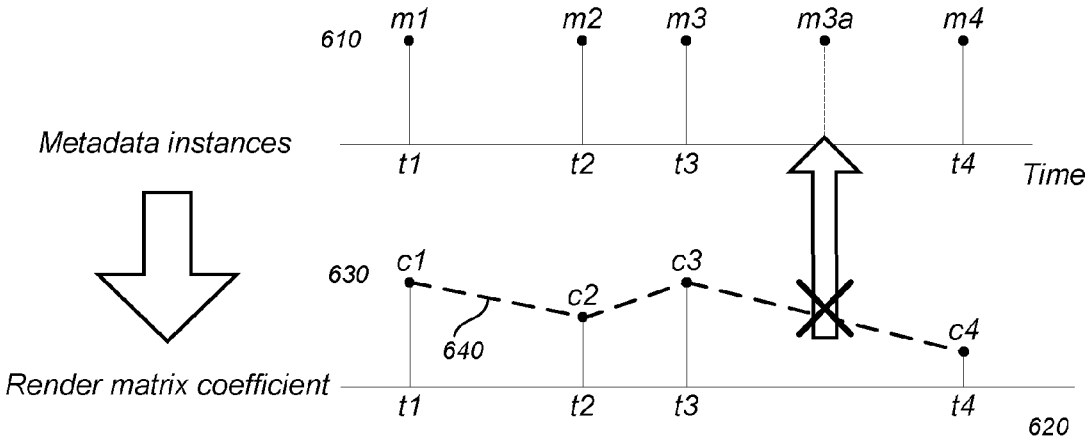
Fig. 6 (Prior art)
FIG. 6 illustrates a typical known process to compute a rendering matrix for a set of metadata instances.

FIG. 6 illustrates a typical known process to compute rendering matrices for rendering of audio signals or audio objects, based on a set of metadata instances. As shown in FIG. 6, a set of metadata instances (m1 to m4) 610 correspond to a set of points in time (t1 to t4) which are indicated by their position along the time axis 620. Subsequently, each metadata instance is converted to a respective rendering matrix (c1 to c4) 630, or rendering setting, which is valid at the same time point as the metadata instance. Thus, as shown, metadata instance m1 creates rendering matrix c1 at time t1, metadata instance m2 creates rendering matrix c2 at time t2, and so on. For simplicity, FIG. 6 shows only one rendering matrix for each metadata instance m1 to m4. In practical systems, however, a rendering matrix c1 may comprise a set of rendering matrix coefficients or gain coefficients $c_{1,i,j}$ to be applied to respective audio signals $x_i(t)$ to create output signals $y_j(t)$:

$$y_j(t)=\Sigma_i x_i(t)c_{1,i,j}.$$

The rendering matrices 630 generally comprise coefficients that represent gain values at different points in time. Metadata instances are defined at certain discrete points in time, and for audio samples in-between the metadata time points, the rendering matrix is interpolated, as indicated by the dashed line 640 connecting the rendering matrices 630. Such interpolation can be performed linearly, but also other interpolation methods can be used (such as band-limited interpolation, sine/cosine interpolation, and etc.). The time interval between the metadata instances (and corresponding rendering matrices) is referred to as an "interpolation duration," and such intervals may be uniform or they may be different, such as the longer interpolation duration between times t3 and t4 as compared to the interpolation duration between times t2 and t3.

In many cases, the calculation of rendering matrix coefficients from metadata instances is well-defined, but the reverse process of calculating metadata instances given a (interpolated) rendering matrix, is often difficult, or even impossible. In this respect, the process of generating a rendering matrix from metadata can sometimes be regarded as a cryptographic one-way function. The process of calculating new metadata instances between existing metadata instances is referred to as "resampling" of the metadata. Resampling of metadata is often required during certain audio processing tasks. For example, when audio content is edited, by cutting/merging/mixing and so on, such edits may occur in between metadata instances. In this case, resampling of the metadata is required. Another such case is when audio and associated metadata are encoded with a frame-based audio codec. In this case, it is desirable to have at least one metadata instance for each audio codec frame, preferably with a time stamp at the start of that codec frame, to improve resilience of frame losses during transmission. Moreover, interpolation of metadata is also ineffective for certain types of metadata, such as binary-valued metadata, where standard techniques would derive the incorrect value more or less every second time. For example, if binary flags such as zone exclusion masks are used to exclude certain objects from the rendering at certain points in time, it is virtually impossible to estimate a valid set of metadata from the rendering matrix coefficients or from neighboring instances of metadata. This is shown in FIG. 6 as a failed attempt to extrapolate or derive a metadata instance m3*a* from the rendering matrix coefficients in the interpolation duration between times t3 and t4. As shown in FIG. 6, metadata instances $m_x$ are only definitely defined at certain discrete points in time $t_x$, which in turn produces the associated set of matrix coefficients $c_x$. In between these discrete times $t_x$, the sets of matrix coefficients must be interpolated based on past or future metadata instances. However, as described above, present metadata interpolation schemes suffer from loss of spatial audio quality due to unavoidable inaccuracies in metadata interpolation processes. Alternative interpolation schemes, according to example embodiments, will be described below with reference to FIGS. 7-11.

In the exemplary embodiments described with reference to FIGS. 1-5, the metadata 122, 222 associated with the N audio objects 120, 220 and the metadata 522 associated with the K objects 522 originate, at least in some example embodiments, from clustering components 409 and 509, and may be referred to as cluster metadata. Further, the metadata 125, 325 associated with the downmix signals 124, 324 may be referred to as downmix metadata.

As described with reference to FIGS. 1, 4 and 5, the downmix component 102 may calculate the M downmix signals 124 by forming combinations of the N audio objects 120 in a signal-adaptive manner, i.e. according to a criterion which is independent of any loudspeaker configuration. Such operation of the downmix component 102 is characteristic of example embodiments within a first aspect. According to example embodiments within other aspects, the downmix component 102 may e.g. calculate the M downmix signals 124 by forming combinations of the N audio objects 120 in a signal-adaptive manner, or, alternatively, such that the M downmix signals are suitable for playback on the channels of a speaker configuration with M channels, i.e. as a backwards compatible downmix.

In an example embodiment, the encoder 400 described with reference to FIG. 4 employs a metadata and side information format particularly suitable for resampling, i.e. for generating additional metadata and side information instances. In the present example embodiment, the analysis component 106 calculates the side information 128 in a form which includes a plurality of side information instances specifying respective desired reconstruction settings for reconstructing the N audio objects 120, and, for each side information instance, transition data including two independently assignable portions which in combination define a point in time to begin a transition from a current reconstruction setting to the desired reconstruction setting specified by the side information instance, and a point in time to complete the transition. In the present example embodiment, the two independently assignable portions of the transition data for each side information instance are: a time stamp indicating the point in time to begin the transition to the desired reconstruction setting and an interpolation duration parameter indicating a duration for reaching the desired reconstruction setting from the point in time to begin the transition to the desired reconstruction setting. The interval during which a transition is to take place is in the present example embodiment uniquely defined by the time at which the transition is to begin and the duration of the transition interval. This particular form of the side information 128 will be described below with reference to FIGS. 7-11. It is to be understood that there are several other ways to uniquely define this transition interval. For example, a reference point in the form of a start, end or middle point of the interval, accompanied by the duration of the interval, may be employed in the transition data to uniquely define the interval. Alternatively, the start and end points of the interval may be employed in the transition data to uniquely define the interval.

In the present example embodiment, the clustering component 409 reduces the first plurality of audio objects 421 to a second plurality of audio objects, here corresponding to the N audio objects 120 of FIG. 1. The clustering component 409 calculates the cluster metadata 122 for the generated N audio objects 120 which enables rendering of the N audio objects 122 in a renderer 210 at a decoder side. The clustering component 409 provides the cluster metadata 122 in a form which includes a plurality of cluster metadata instances specifying respective desired rendering settings for rendering the N audio objects 120, and, for each cluster metadata instance, transition data including two independently assignable portions which in combination define a point in time to begin a transition from a current rendering setting to the desired rendering setting specified by the cluster metadata instance, and a point in time to complete the transition to the desired rendering setting. In the present example embodiment, the two independently assignable portions of the transition data for each cluster metadata instance are: a time stamp indicating the point in time to begin the transition to the desired rendering setting and an interpolation duration parameter indicating a duration for reaching the desired rendering setting from the point in time to begin the transition to the desired rendering setting. This particular form of the cluster metadata 122 will be described below with reference to FIGS. 7-11.

In the present example embodiment, the downmix component 102 associates each downmix signal 124 with a spatial position and includes the spatial position in the downmix metadata 125 which allows rendering of the M downmix signals in a renderer 310 at a decoder side. The downmix component 102 provides the downmix metadata 125 in a form which includes a plurality of downmix metadata instances specifying respective desired downmix rendering settings for rendering the downmix signals, and, for each downmix metadata instance, transition data including two independently assignable portions which in combination define a point in time to begin a transition from a current downmix rendering setting to the desired downmix rendering setting specified by the downmix metadata instance, and a point in time to complete the transition to the desired downmix rendering setting. In the present example embodiment, the two independently assignable portions of the transition data for each downmix metadata instance are: a time stamp indicating the point in time to begin the transition to the desired downmix rendering setting and an interpolation duration parameter indicating a duration for reaching the desired downmix rendering setting from the point in time to begin the transition to the desired downmix rendering setting.

In the present example embodiment, the same format is employed for the side information 128, the cluster metadata 122 and the downmix metadata 125. This format will now be described with reference to FIGS. 7-11 in terms of metadata for rendering of audio signals. However, it is to be understood that in the following examples described with reference to FIGS. 7-11, terms or expressions like "metadata for rendering of audio signals" may just as well be replaced by corresponding terms or expressions like "side information for reconstruction of audio objects", "cluster metadata for rendering of audio objects" or "downmix metadata for rendering of downmix signals".

Figure 7:
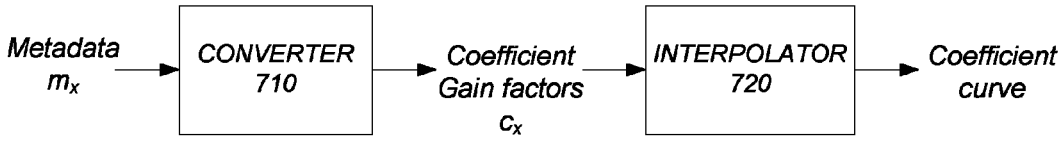
FIG. 7 illustrates the derivation of a coefficient curve employed in rendering of audio signals.

FIG. 7 illustrates the derivation, based on metadata, of coefficient curves employed in rendering of audio signals, according to an example embodiment. As shown in FIG. 7, a set of metadata instances $m_x$ generated at different points in time $t_x$, e.g. associated with unique time stamps, are converted by a converter 710 into corresponding sets of matrix coefficient values $c_x$. These sets of coefficients represent gain values, also referred to as gain factors, to be employed for rendering of the audio signals to various speakers and drivers in a playback system to which the audio content is to be rendered. An interpolator 720 then interpolates the gain factors $c_x$ to produce a coefficient curve between the discrete times $t_x$. In an embodiment, the time stamps $t_x$ associated with each metadata instance $m_x$ may correspond to random points in time, synchronous points in time generated by a clock circuit, time events related to the audio content, such as frame boundaries, or any other appropriate timed event. Note that, as described above, the description provided with reference to FIG. 7 applies analogously to side information for reconstruction of audio objects.

Figure 8:
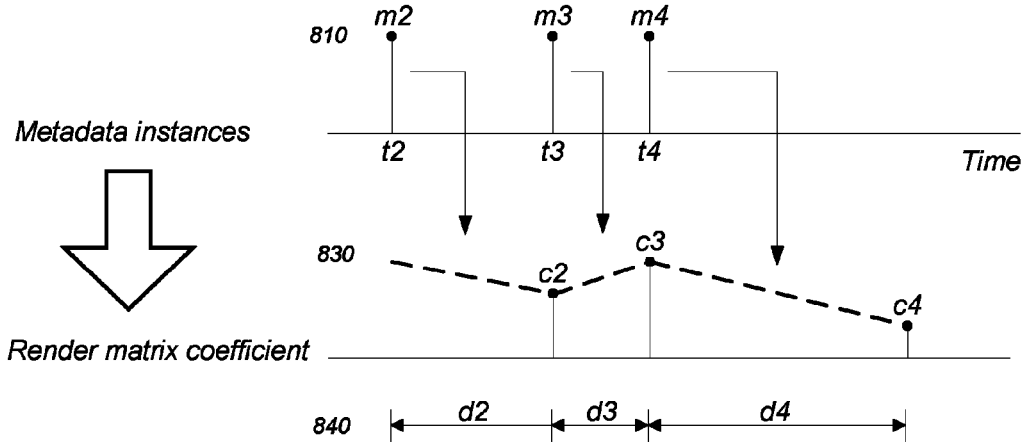
FIG. 8 illustrates a metadata instance interpolation method, according to an example embodiment.

FIG. 8 illustrates a metadata format according to an embodiment (and as described above, the following description applies analogously to a corresponding side information format), which addresses at least some of the interpolation problems associated with present methods, as described above, by defining a time stamp as the start time of a transition or an interpolation, and augmenting each metadata instance with an interpolation duration parameter that represents the transition duration or interpolation duration (also referred to as "ramp size"). As shown in FIG. 8, a set of metadata instances m2 to m4 (810) specifies a set of rendering matrices c2 to c4 (830). Each metadata instance is generated at a particular point in time $t_x$, and each metadata instance is defined with respect to its time stamp, m2 to t2, m3 to t3, and so on. The associated rendering matrices 830 are generated after performing transitions during respective interpolation durations d2, d3, d4 (830), from the associated time stamp (t2 to t4) of each metadata instance 810. An interpolation duration parameter indicating the interpolation duration (or ramp size) is included with each metadata instance, i.e., metadata instance m2 includes d2, m3 includes d3, and so on. Schematically this can be represented as follows: $m_x$=(metadata($t_x$), $d_x$)→$c_x$. In this manner, the metadata essentially provides a schematic of how to proceed from a current rendering setting (e.g., the current rendering matrix resulting from previous metadata) to a new rendering setting (e.g., the new rendering matrix resulting from the current metadata). Each metadata instance is meant to take effect at a specified point in time in the future relative to the moment the metadata instance was received and the coefficient curve is derived from the previous state of the coefficient. Thus, in FIG. 8, m2 generates c2 after a duration d2, m3 generates c3 after a duration d3 and m4 generates c4 after a duration d4. In this scheme for interpolation, the previous metadata need not be known, only the previous rendering matrix or rendering state is required. The interpolation employed may be linear or non-linear depending on system constraints and configurations.

Figure 9:
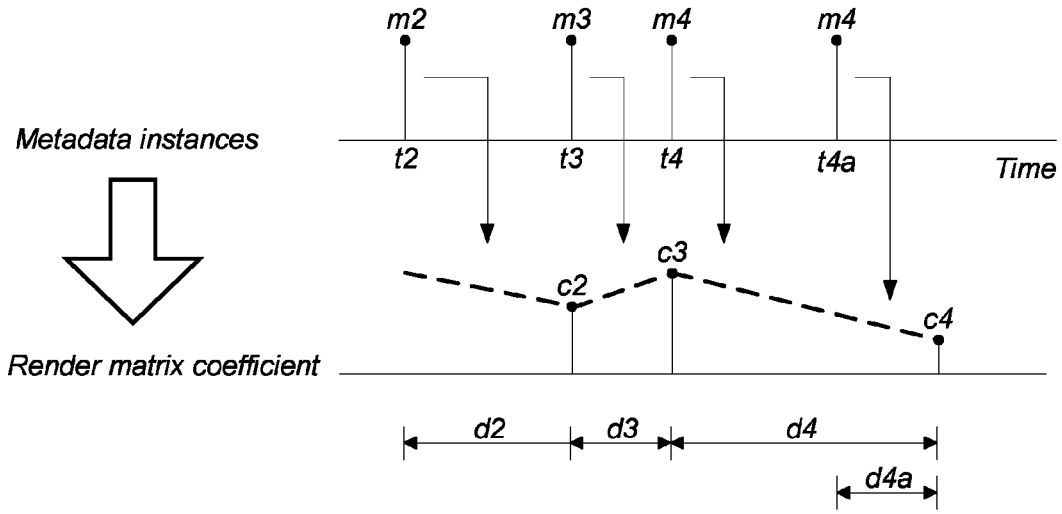
FIGS. 9 and 10 illustrate examples of introduction of additional metadata instances, according to example embodiments.

The metadata format of FIG. 8 allows for lossless resampling of metadata, as shown in FIG. 9. FIG. 9 illustrates a first example of lossless processing of metadata, according to an example embodiment (and as described above, the following description applies analogously to a corresponding side information format). FIG. 9 shows metadata instances m2 to m4 that refer to the future rendering matrices c2 to c4, respectively, including interpolation durations d2 to d4. The time stamps of the metadata instances m2 to m4 are given as t2 to t4. In the example of FIG. 9, a metadata instance m4*a*, at time t4*a*, is added. Such metadata may be added for several reasons, such as to improve error resilience of the system or to synchronize metadata instances with the start/end of an audio frame. For example, time t4*a* may represent the time that an audio codec employed for coding audio content associated with the metadata starts a new frame. For lossless operation, the metadata values of m4*a* are identical to those of m4 (i.e. they both describe a target rendering matrix c4), but the time d4*a* to reach that point has been reduced by d4−d4*a*. In other words, metadata instance m4*a* is identical to that of the previous metadata instance m4 so that the interpolation curve between c3 and c4 is not changed. However, the new interpolation duration d4*a*, is shorter than the original duration d4. This effectively increases the data rate of the metadata instances, which can be beneficial in certain circumstances, such as error correction.

Figure 10:
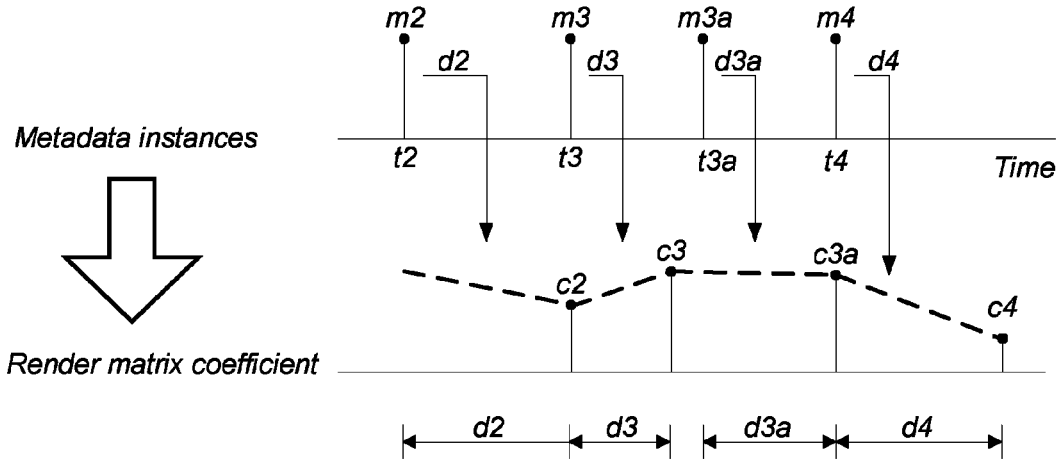

A second example of lossless metadata interpolation is shown in FIG. 10 (and as described above, the following description applies analogously to a corresponding side information format). In this example, the goal is to include a new set of metadata m3*a* in between two metadata instances m3 and m4. FIG. 10 illustrates a case where the rendering matrix remains unchanged for a period of time. Therefore, in this situation, the values of the new set of metadata m3*a* are identical to those of the prior metadata m3, except for the interpolation duration d3*a*. The value of the interpolation duration d3*a* should be set to the value corresponding to t4−t3*a*, i.e. to the difference between time t4 associated with the next metadata instance m4 and the time t3*a* associated with the new set of metadata m3*a*. The case illustrated in FIG. 10 may for example occur when an audio object is static and an authoring tool stops sending new metadata for the object due to this static nature. In such a case, it may be desirable to insert new metadata instances m3*a*, e.g. to synchronize the metadata with codec frames.

Figure 11:
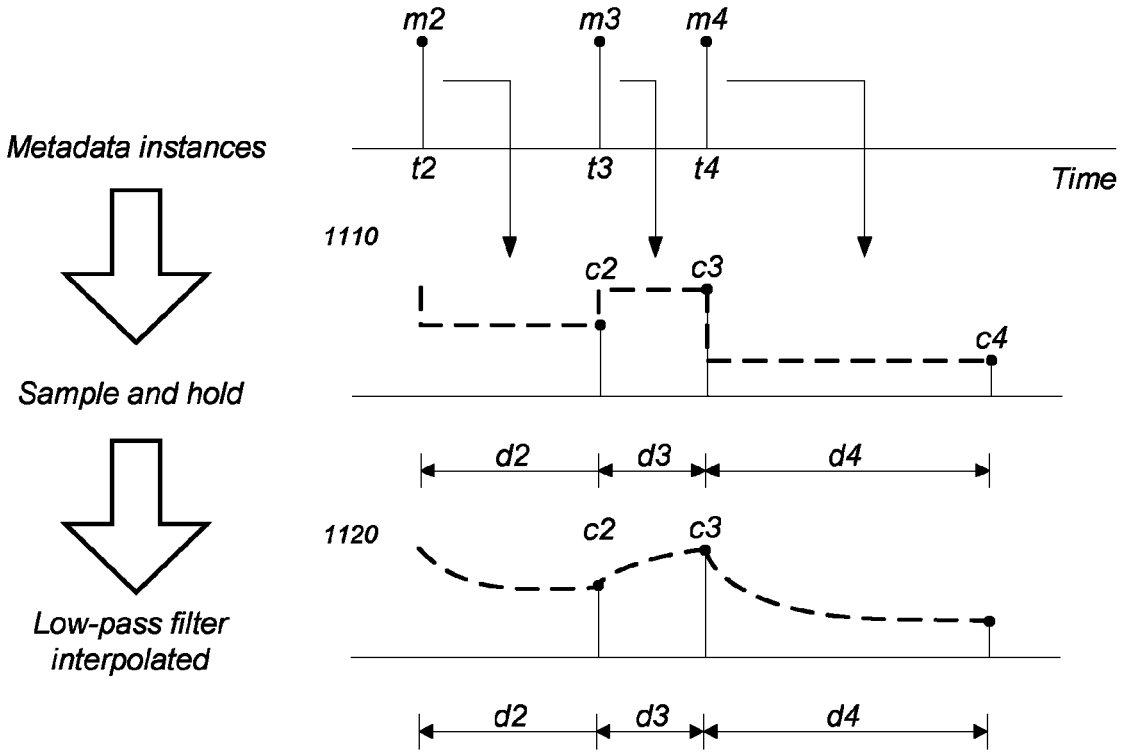
FIG. 11 illustrates an interpolation method using a sample-and-hold circuit with a low-pass filter, according to an example embodiment.

In the examples illustrated in FIGS. 8 to 10, the interpolation from a current to a desired rendering matrix or rendering state was performed by linear interpolation. In other example embodiments, different interpolation schemes may also be used. One such alternative interpolation scheme uses a sample-and-hold circuit combined with a subsequent low-pass filter. FIG. 11 illustrates an interpolation scheme using a sample-and-hold circuit with a low-pass filter, according to an example embodiment (and as described above, the following description applies analogously to a corresponding side information format). As shown in FIG. 11, the metadata instances m2 to m4 are converted to sample-and-hold rendering matrix coefficients c2 and c3. The sample-and-hold process causes the coefficient states to jump immediately to the desired state, which results in a step-wise curve 1110, as shown. This curve 1110 is then subsequently low-pass filtered to obtain a smooth, interpolated curve 1120. The interpolation filter parameters (e.g., cut-off frequency or time constant) can be signaled as part of the metadata, in addition to the time stamps and the interpolation duration parameters. It is to be understood that different parameters may be used depending on the requirements of the system and the characteristics of the audio signal.

In an example embodiment, the interpolation duration or ramp size can have any practical value, including a value of or substantially close to zero. Such small interpolation duration is especially helpful for cases such as initialization in order to enable setting the rendering matrix immediately at the first sample of a file, or allowing for edits, splicing, or concatenation of streams. With this type of destructive edits, having the possibility to instantaneously change the rendering matrix can be beneficial to maintain the spatial properties of the content after editing.

In an example embodiment, the interpolation scheme described herein is compatible with the removal of metadata instances (and analogously with the removal of side information instances, as described above), such as in a decimation scheme that reduces metadata bitrates. Removal of metadata instances allows the system to resample at a frame rate that is lower than an initial frame rate. In this case, metadata instances and their associated interpolation duration data that are provided by an encoder may be removed based on certain characteristics. For example, an analysis component in an encoder may analyze the audio signal to determine if there is a period of significant stasis of the signal, and in such a case remove certain metadata instances already generated to reduce bandwidth requirements for the transmittal of data to a decoder side. The removal of metadata instances may alternatively or additionally be performed in a component separate from the encoder, such as in a decoder or in a transcoder. A transcoder may remove metadata instances that have been generated or added by the encoder, and may be employed in a data rate converter that re-samples an audio signal from a first rate to a second rate, where the second rate may or may not be an integer multiple of the first rate. Alternatively to analyzing the audio signal in order to determine which metadata instances to remove, the encoder, decoder or transcoder may analyze the metadata. For example, with reference to FIG. 10, a difference may be computed between a first desired reconstruction setting c3 (or reconstruction matrix), specified by a first metadata instance m3, and desired reconstruction settings c3*a* and c4 (or reconstruction matrices) specified by metadata instances m3*a* and m4 directly succeeding the first metadata instance m3. The difference may for example be computed by employing a matrix norm to the respective rendering matrices. If the difference is below a predefined threshold, e.g. corresponding to a tolerated distortion of the reconstructed audio signals, the metadata instances m3*a* and m4 succeeding the first metadata instance m2 may be removed. In the example illustrated in FIG. 10, the metadata instance m3*a* directly succeeding the first metadata instance m3 specifies the same rendering settings c3=c3*a* as the first metadata instance m3 and will therefore be removed, while the next metadata setting m4 specifies a different rendering setting c4 and may, depending on the threshold employed, be kept as metadata.

Figure 12:
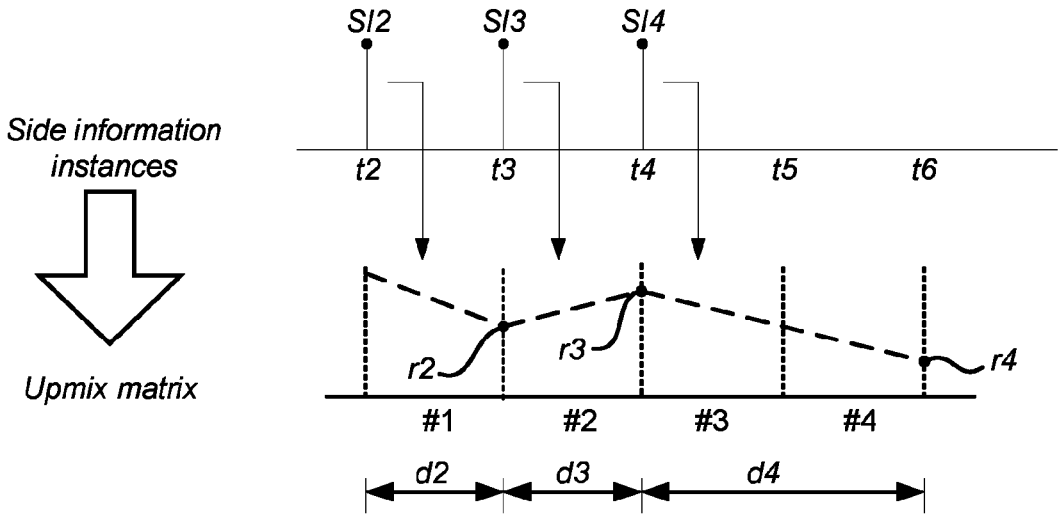
FIGS. 12 and 13 illustrate embodiments of upmix parameter interpolation in a method for reconstructing audio objects based on a data stream comprising a plurality of time frames.

In the following, embodiments of upmix parameter interpolation in a method for reconstructing audio objects based on a data stream comprising a plurality of time frames will be described in conjunction with FIGS. 12-15. It should be noted that the interpolation scheme and syntax described in conjunction with FIGS. 12-15 also is applicable when rendering the reconstructed audio objects based on rendering parameters derived from time-variable cluster metadata received in the data stream, e.g. as discussed in conjunction with FIG. 8 above. The method for reconstructing audio objects is implemented by a decoder in an audio system. The decoder receives a data stream, e.g. a bit stream, comprising M downmix signals which are combinations of N audio objects, wherein N>1 and M≤N, and time-variable side information including parameters which allow reconstruction of a set of audio objects formed on the basis of the N audio objects from the M downmix signals. The data stream thus comprises a plurality of side information instances. In FIG. 12, three side information instances S12, S13, S14 are shown. The data stream corresponds to a plurality of time frames. In FIG. 12, four time frames #1, #2, #3, #4 are shown. In order to achieve smooth reconstruction of the plurality of audio objects, interpolation between successive reconstruction settings, e.g. upmix matrixes, may be advantageous. Each side information instance S12, S13, S14 comprises a transition data including two independently assignable portions which in combination define a point in time to begin a transition from a current reconstruction setting to a desired reconstruction setting specified by the side information instance, and a point in time to complete the transition. For example, the side information instance S13 received at the starting point t3 of the second time frame #2 define a point in time t3 to begin a transition from a current reconstruction setting r2 to a desired reconstruction setting r3. The desired reconstruction setting r3 is specified by the side information instance S13. Further, the side information instance S13 defines a point t3+d3 where the transition to the desired reconstruction setting r3 should be completed.

As can be seen in FIG. 12, the point in time defined by the transition data of the each side information instance for beginning a transition corresponds to one of the plurality of time frames, e.g. the point in time to start the transisition between the reconstruction setting r2 and the reconstruction setting r3 falls inside the second time frame #2. In FIG. 12, the first frame covers the time interval [t2, t3[, the second frame, immediately subsequent to the first frame, covers the time interval [t3, t4[ and so on. Consequently, the point in time defined by the transition data of specific side information instance S13 for completing a transition corresponds to the third time frame #3. In other words, the point in time defined by the transition data of the side information instance S13 for completing the transition between the reconstruction setting r2 and the reconstruction setting r3 corresponds to the third frame #3 which is subsequent to the second frame #2 in which the transition begun. Since the syntax allow for transitions to end in a frame subsequent to the frame in which the transition started, an improved flexibility is achieved.

Turning to the third side information instance S14, a further example of a lengthy transition can be seen. The transition from the reconstruction setting r3 to the reconstruction setting r4 last over two whole frames and ends at the end of the fourth frame (which coincides with the beginning of the fifth frame).

In FIG. 12, S12 generates r2 as the reconstruction setting after a duration d2, S13 generates r3 as the reconstruction setting after a duration d3 and S14 generates r4 as the reconstruction setting after a duration d4. In other words, at the point in time t3 where the second frame #2 starts, the reconstruction of the N audio objects from M downmix signals which are combinations of N audio objects is performed according to the reconstruction setting r2. At the point in time t4 where the third frame #3 starts, the reconstruction of the N audio objects is performed according to the reconstruction setting r3. Between the two points in time, i.e. during the duration d3 of the transition between the two reconstruction settings r2, r3, a smooth interpolation of the two reconstruction settings r2, r3 is used for performing the reconstruction of the N audio objects. The smooth interpolation may be a linear interpolation according to the following.

The syntax shown below provides an example of an element in the bitstream which is sent once per frame, indicating the number of side information instances in that frame (n_dpoints, which in this example can be 0, 1, 2, or 3), and for each side information instance (in this example indexed dp=0, 1, 2) the start_pos (i.e. the transition data portion of the specific side information instance that defines the point in time for beginning a transition) and ramp_dur (i.e. the transition data portion of the specific side information instance that defines a duration of the transition, and hence the point in time for completing a transition). The start_pos is specified with respect to the beginning of that frame, and can only be located within that frame. For the example shown in FIG. 12, and in particular for the side information instance S13, the start_pos would be zero to indicate that t3 coincides with the beginning of the frame #2, and the ramp_dur would have a value identifying the duration of one frame (e.g. T), which means that d3 would be T.

| Syntax | No. of bits |
|---|---|
| data_point_info( ) | |
| { | |
| n_dpoints; | 2 |
| for (dp = 0; dp < n_dpoints; dp++) { | |
| start_pos[dp]; | 5 |
| ramp_dur_cod[dp]; | 6 |
| } | |
| } | |

In this example, the length of a frame is 32 QMF samples, and start_pos (which can have values ranging from 0 to 31) can be anywhere inside the frame, while the ramp duration is computed as ramp_dur=ramp_dur_cod+1 and can be as short as an immediate transition from one QMF sample to the next (ramp_dur=1) or as long as the duration of two frames, i.e. 64 QMF samples (ramp_dur=64). The ramp_dur_cod is the encoded version of ramp_dur which in this case can have values ranging from 0 to 63 and consequently can be encoded with 6 bits.

Thus, assuming a frame length of 32 QMF samples, numbered ts=0 . . . 31, then the interpolation of an upmix matrix element m(ts), i.e. reconstruction setting, from the "old" to the "new" values is as follows, based on start_pos (point in time defined by the transition data of the specific side information instance for beginning a transition) and ramp_dur (start_pos and ramp_dur are used to calculate the point in time defined by the transition data for completing a transition).

To map the following example to the notation used in the context of FIG. 12, one can assume that S12 was sent in a frame preceding frame 1, such that the reconstruction setting r2=old=A was already applied at the beginning of frame 1 and kept constant unchanged until the next transition starts. S13 is sent as part of frame 1, and the transition data of S13 has values such that the transition starts in the middle of frame 1, has a duration of one frame, and is completed in the middle of frame 2, where the reconstruction setting r3=new=B is reached.

TABLE 1

Example of interpolation of reconstruction setting

| Reconstruction setting (m) for point in time (ts) | Condition |
|---|---|
| m(ts) = old | ts < start_pos |
| m(ts) = old + (new − old)*(ts + 1 − start_pos)/ramp_dur | start_pos <= ts < start_pos + ramp_dur |
| m(ts) = new | start_pos + ramp_dur <= ts |

As have been described above, transitions can extend beyond the end of a frame. This for example enables loss-less reframing of the side information data as described above. See the following example 1:

frame 0:

...

m(31)=A frame 1: Side information (new=B, start_pos=16, ramp_dur=32)

$$m(0) = A$$

$$\ldots$$

$$m(15) = A$$

$$m(16) = A + (B - A) * 1/32$$

$$\ldots$$

$$m(31) = A + (B - A) * 16/32$$

frame 2:

$$m(0) = A + (B - A) * 17/32$$

$$\ldots$$

$$m(14) = A + (B - A) * 31/32$$

$$m(15) = B$$

$$\ldots$$

$$m(31) = B$$

Figure 13:
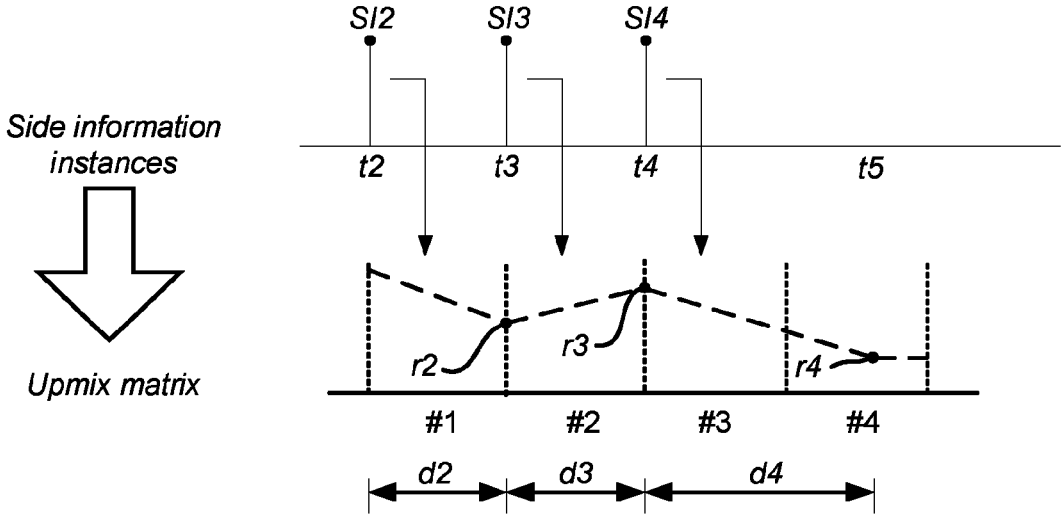

A similar example is shown in FIG. 13. FIG. 13 describes almost the same scenario as FIG. 12 but with some differences. In FIG. 13, the translation defined by the third side information instance S14 between the current reconstruction setting r3 and the desired reconstruction setting r4 specified by the side information instance S14 continues from the third frame #3 and into the fourth frame #4 in which it ends in the middle of the frame #4. For the fourth frame #4, no corresponding side information instances are received in the data stream. In that case, the decoder implementing the reconstruction method, as described in example 1 above, may, if there is a transition defined by a side information instance corresponding to the previous time frame #3 that is not completed at the end of frame #3, continue to perform reconstruction based on the not completed transition. In FIG. 13, this is clearly shown in that the transition between the reconstruction setting r3 and the reconstruction setting r4 continues when the fourth frame #4 starts. Moreover, when the transition ends in a point in time t5=t4+d4 in the middle of the frame #5, the reconstruction in the rest of the points in time of the frame #5 is performed using the reconstruction setting r4.

Figure 14:
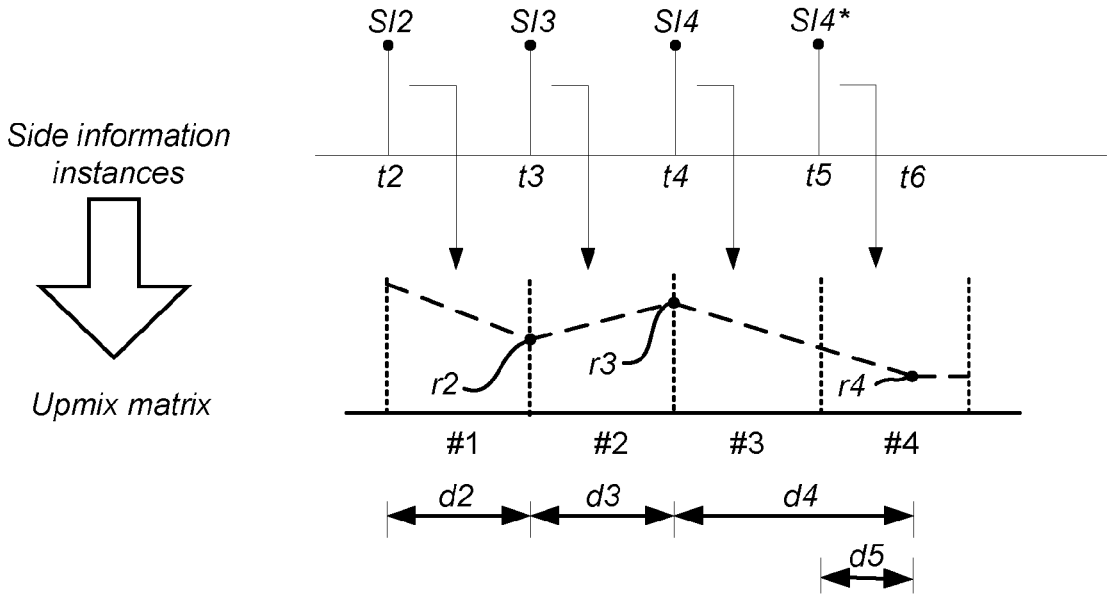
FIG. 14 illustrate an example of introduction of an additional side information comprising a upmix matrix, according to example embodiments.
Figure 15:
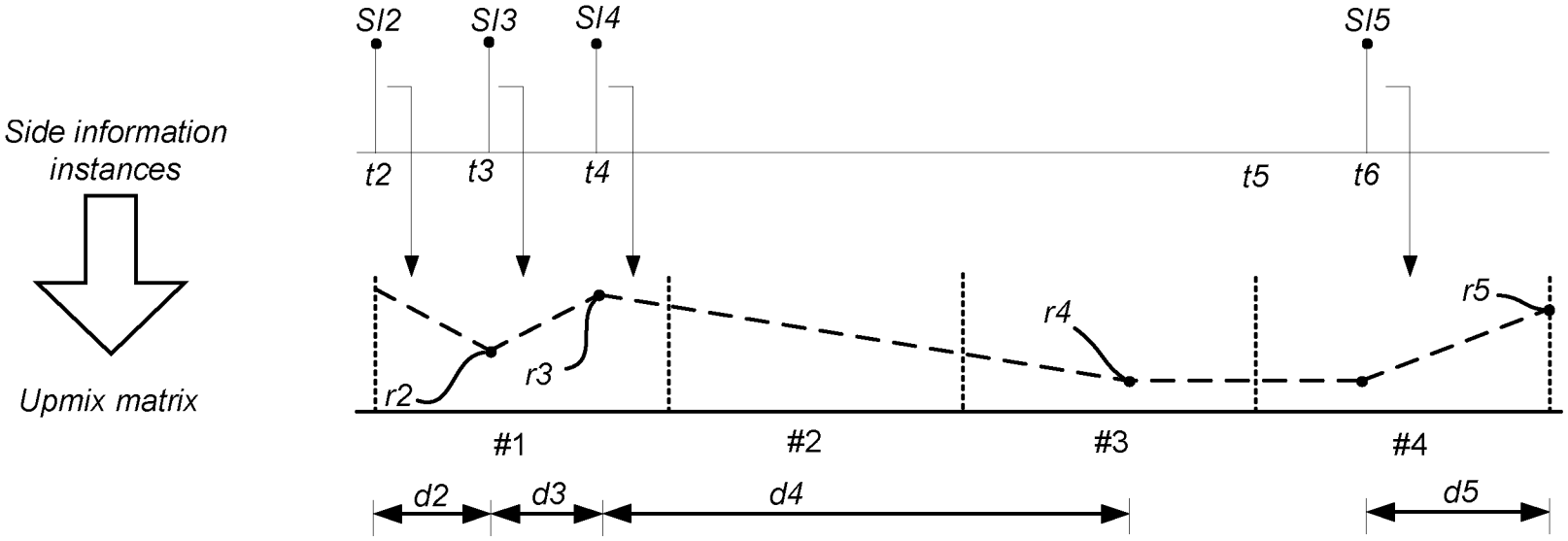
FIG. 15 illustrates a further embodiment of upmix parameter interpolation in a method for reconstructing audio objects based on a data stream comprising a plurality of time frames.

FIG. 14 describe a scenario at an encoder or transcoder wherein, for a specific time frame #4 of the plurality of time frames #1-#4, there is zero corresponding side information instances. In order to be able to transmit a bitstream which include at least one side information instance for each time frame of the bitstream, an additional side information instance S14*may be generated by copying the side information instance S14 corresponding to the previous frame #3 and modifying the point in time to begin a transition to a point in time where the time frame #4 begins. This additional side information instance S14*is the included in the bitstream. In the syntax of example 1 above, also the ramp_dur is modified to a new duration d5. For the decoder receiving the bitstream and reconstructing the audio objects from it, the interpolation of the reconstruction setting would be reflected by, in the notation used in example 1 above, at frame 2 receive a side information instance with the following data:

Side information (new=B, start_pos=0, ramp_dur=16)

The resulting interpolated reconstruction setting m(ts) for frame 2 would be exactly the same as given in example 1, which shows that the additional side information instance S14*does not affect the resulting interpolation, and hence that the addition of this side information instance is lossless.

According to further embodiments, for each specific time frame of the plurality of time frames there is zero or more corresponding side information instances in which the point in time defined by the transition data for beginning a transition corresponds to the specific time frame. This embodiment is described in FIG. 15, wherein for the first frame #1, three side information instances S12, S13, S14 are received. For the following two frames #2, #3, no side information instance is received. For the fourth frame #4, the received side information instance S15 defines a point in time t6 to start a transition from the current reconstruction setting r4 to a desired reconstruction setting r5, which time point t6 differs from the first time point t5 of the fourth frame #4. Consequently, for the time period between the two time points t5, t6, reconstruction is performed according to the current reconstruction setting r4. Also in the examples illustrated in FIGS. 12 and 13, for the fourth frame #4, there are zero side information instances that correspond to that frame.

In the decoder 200 described with reference to FIG. 2, the object reconstruction component 206 may employ interpolation as part of reconstructing the N audio objects 220 based on the M downmix signals 224 and the side information 228. In analogy with the interpolation scheme described with reference to FIGS. 7-11, reconstructing the N audio objects 220 may for example include: performing reconstruction according to a current reconstruction setting; beginning, at a point in time defined by the transition data for a side information instance, a transition from the current reconstruction setting to a desired reconstruction setting specified by the side information instance; and completing the transition to the desired reconstruction setting at a point in time defined by the transition data for the side information instance.

Similarly, the renderer 210 may employ interpolation as part of rendering the reconstructed N audio objects 220 in order to generate the multichannel output signal 230 suitable for playback. In analogy with the interpolation scheme described with reference to FIGS. 7-11, the rendering may include: performing rendering according to a current rendering setting; beginning, at a point in time defined by the transition data for a cluster metadata instance, a transition from the current rendering setting to a desired rendering setting specified by the cluster metadata instance; and completing the transition to the desired rendering setting at a point in time defined by the transition data for the cluster metadata instance.

In some example embodiments, the object reconstruction section 206 and the renderer 210 may be separate units, and/or may correspond to operations performed as separate processes. In other example embodiments, the object reconstruction section 206 and the renderer 210 may be embodied as a single unit or process in which reconstruction and rendering is performed as a combined operation. In such example embodiments, matrices employed for reconstruction and rendering may be combined into a single matrix which may be interpolated, instead of performing interpolation on a rendering matrix and a reconstruction matrix, separately.

In the low-complexity decoder 300, described with reference to FIG. 3, the renderer 310 may perform interpolation as part of rendering the M downmix signals 324 to the multichannel output 330. In analogy with the interpolation scheme described with reference to FIGS. 7-11, the rendering may include: performing rendering according to a current downmix rendering setting; beginning, at a point in time defined by the transition data for a downmix metadata instance, a transition from the current downmix rendering setting to a desired downmix rendering setting specified by the downmix metadata instance; and completing the transition to the desired downmix rendering setting at a point in time defined by the transition data for the downmix metadata instance. As previously described, the renderer 310 may be comprised in the decoder 300 or may be a separate device/unit. In example embodiments where the renderer 310 is separate from the decoder 300, the decoder may output the downmix metadata 325 and the M downmix signals 324 for rendering of the M downmix signals in the renderer 310.

EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

All the figures are schematic and generally only show parts which are necessary in order to elucidate the disclosure, whereas other parts may be omitted or merely suggested. Unless otherwise indicated, like reference numerals refer to like parts in different figures.

What is claimed is:

1. A method for encoding audio objects as a data stream, comprising:

receiving N audio objects, wherein N>1;

calculating M downmix signals, wherein M≤N, by forming combinations of the N audio objects;

calculating time-variable side information including parameters which allow reconstruction of a set of audio objects formed on the basis of the N audio objects from the M downmix signals; and including the M downmix signals and the side information in a data stream for transmittal to a decoder, wherein the data stream corresponds to a plurality of time frames, wherein the method further comprises including, in the data stream:

a plurality of side information instances specifying respective desired reconstruction settings for reconstructing said set of audio objects formed on the basis of the N audio objects; and for each side information instance, transition data including two independently assignable portions which in combination define a point in time to begin a transition from a current reconstruction setting to the desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame.

2. The method of claim 1, wherein for at least one of the plurality of side information instances, the second time frame is subsequent to the first time frame.

3. The method of claim 1, wherein the point in time defined by the transition data for beginning a transition is defined relative to a point in time where the corresponding frame begins.

4. The method of claim 1, wherein for each specific time frame of the plurality of time frames there are zero or more corresponding side information instances in which the point in time defined by the transition data for beginning a transition corresponds to the specific time frame.

5. The method of claim 1, wherein for a specific time frame of the plurality of time frames there are zero corresponding side information instances, the method further comprises, if there is a transition defined by a side information instance corresponding to a previous time frame that is not completed for a point in time where the specific time frame begins, generating an additional side information instance by copying the side information instance corresponding to the previous frame and modifying the point in time to begin a transition to a point in time where the time frame begins, and including the additional side information instance in the bitstream, if there is no transition defined by a side information instance corresponding to a previous time frame that is not completed for a point in time where the specific time frame begins, generating an additional side information instance by copying the side information instance corresponding to the previous frame and modifying the point in time to begin a transition to a point in time where the time frame begins, and modifying the point in time for completing a transition to the point in time where the time frame begins, and including the additional side information instance in the bitstream.

6. The method of claim 1, further comprising a clustering procedure for reducing a first plurality of audio objects to a second plurality of audio objects, wherein the N audio objects constitute either the first plurality of audio objects or the second plurality of audio objects, wherein said set of audio objects formed on the basis of the N audio objects coincides with the second plurality of audio objects, and wherein the clustering procedure comprises:

calculating time-variable cluster metadata including spatial positions for the second plurality of audio objects; and further including, in the data stream:

a plurality of cluster metadata instances specifying respective desired rendering settings for rendering the second set of audio objects; and for each cluster metadata instance, transition data including two independently assignable portions which in combination define a point in time to begin a transition from a current rendering setting to the desired rendering setting specified by the cluster metadata instance, and a point in time to complete the transition to the desired rendering setting specified by the cluster metadata instance.

7. A non-transitory computer-readable storage medium comprising instructions which, when executed by a processor, cause the processor to perform the method of claim 1.

8. A method for reconstructing audio objects based on a data stream, comprising:

receiving a data stream comprising M downmix signals which are combinations of N audio objects, wherein N>1 and M≤N, and time-variable side information including parameters which allow reconstruction of a set of audio objects formed on the basis of the N audio objects from the M downmix signals; and reconstructing, based on the M downmix signals and the side information, said set of audio objects formed on the basis of the N audio objects, wherein the data stream corresponds to a plurality of time frames, wherein the data stream comprises a plurality of side information instances, wherein the data stream further comprises, for each side information instance, transition data including two independently assignable portions which in combination define a point in time to begin a transition from a current reconstruction setting to a desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame, and wherein reconstructing said set of audio objects formed on the basis of the N audio objects comprises:

performing reconstruction according to a current reconstruction setting;

beginning, at a point in time defined by the transition data for a side information instance, a transition from the current reconstruction setting to a desired reconstruction setting specified by the side information instance; and completing the transition at a point in time defined by the transition data for the side information instance.

9. The method of claim 8, wherein for at least one of the plurality of side information instances, the second time frame is subsequent to the first time frame.

10. The method of claim 8, wherein the point in time defined by the transition data for beginning a transition is defined relative to a point in time where the corresponding time frame begins.

11. The method of claim 8, wherein for each specific time frame of the plurality of time frames there are zero or more corresponding side information instances in which the point in time defined by the transition data for beginning a transition corresponds to the specific time frame.

12. The method of claim 11, wherein if reconstruction is to be performed for a time frame for which there are zero corresponding side information instances, the method further comprises:

if there is a transition defined by a side information instance corresponding to a previous time frame that is not completed, performing reconstruction based on the not completed transition, otherwise performing reconstruction according to the current reconstruction setting.

13. The method of claim 8, further comprising:

generating one or more additional side information instances specifying substantially the same reconstruction setting as a side information instance directly preceding or directly succeeding the one or more additional side information instances.

14. A non-transitory computer-readable storage medium comprising instructions which, when executed by a processor, cause the processor to perform the method of claim 8.

15. A decoder for reconstructing audio objects based on a data stream, comprising:

a receiving component configured to receive a data stream comprising M downmix signals which are combinations of N audio objects, wherein N>1 and M≤N, and time-variable side information including parameters which allow reconstruction of a set of audio objects formed on the basis of the N audio objects from the M downmix signals; and a reconstructing component configured to reconstruct, based on the M downmix signals and the side information, the set of audio objects formed on the basis of the N audio objects, wherein the data stream corresponds to a plurality of time frames, wherein the data stream comprises a plurality of side information instances, wherein the data stream further comprises, for each side information instance, transition data including two independently assignable portions which in combination define a point in time to begin a transition from a current reconstruction setting to a desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame and wherein the reconstructing component is configured to reconstruct said set of audio objects formed on the basis of the N audio objects by at least:

performing reconstruction according to a current reconstruction setting;

beginning, at a point in time defined by the transition data for a side information instance, a transition from the current reconstruction setting to a desired reconstruction setting specified by the side information instance; and completing the transition at a point in time defined by the transition data for the side information instance.

16. A method for transcoding side information encoded together with M audio signals in a data stream, wherein the method comprises:

receiving a data stream corresponding to a plurality of time frames;

extracting, from the data stream, M audio signals and associated time-variable side information including parameters which allow reconstruction of a set of audio objects from the M audio signals, wherein M≥1, and wherein the extracted side information includes:

a plurality of side information instances specifying respective desired reconstruction settings for reconstructing the audio objects, and for each side information instance, transition data including two independently assignable portions which in combination define a point in time to begin a transition from a current reconstruction setting to the desired reconstruction setting specified by the side information instance, and a point in time to complete the transition, and wherein for each specific side information instance of the plurality of side information instances:

the point in time defined by the transition data of the specific side information instance for beginning a transition corresponds to a first of the plurality of time frames, wherein the point in time defined by the transition data of the specific side information instance for completing a transition corresponds to a second of the plurality of time frames, the second time frame is either the same as the first time frame or subsequent to the first time frame;

generating one or more additional side information instances specifying substantially the same reconstruction setting as a side information instance directly preceding or directly succeeding the one or more additional side information instances; and including the M audio signals and the side information in a transcoded data stream.

17. The method of claim 16, wherein for at least one of the plurality of side information instances, the second time frame is subsequent to the first time frame.

18. The method of claim 16, wherein the point in time defined by the transition data for beginning a transition is defined relative a point in time where the corresponding frame begins.

19. The method of claim 16, wherein the M audio signals are coded in the received data stream according to a first frame rate, the method further comprising:

processing the M audio signals to change the frame rate according to which the M downmix signals are coded to a second frame rate different than the first frame rate; and resampling the side information to match the second frame rate, such that the transcoded bitstream comprises a plurality of time frames according to the second frame rate, wherein for a specific time frame of the plurality of time frames in the transcoded bitstream, there are zero corresponding side information instances, wherein for that specific time frame the resampling comprises generating an additional side information instance out of the one or more additional side information instances by:

if there is a transition defined by a side information instance corresponding to a previous time frame in the transcoded bitstream that is not completed for a point in time where the specific time frame begins, generating the additional side information instance by copying the side information instance corresponding to the previous frame and modifying the point in time to begin a transition to a point in time where the time frame begins, if there is no transition defined by a side information instance corresponding to a previous time frame that is not completed for a point in time where the specific time frame begins, generating an additional side information instance by copying the side information instance corresponding to the previous frame and modifying the point in time to begin a transition to a point in time where the time frame begins, and modifying the point in time for completing a transition to the point in time where the time frame begin.

20. A non-transitory computer-readable storage medium comprising instructions which, when executed by a processor, cause the processor to perform the method of claim 16.

* * * * *